US009638466B2

(12) United States Patent
Mellen

(10) Patent No.: US 9,638,466 B2
(45) Date of Patent: May 2, 2017

(54) FURNACE SYSTEM WITH ACTIVE COOLING SYSTEM AND METHOD

(71) Applicant: Jonathan Y. Mellen, Concord, NH (US)

(72) Inventor: Jonathan Y. Mellen, Concord, NH (US)

( * ) Notice: Subject to any disclaimer, the term of this patent is extended or adjusted under 35 U.S.C. 154(b) by 974 days.

(21) Appl. No.: 13/729,201

(22) Filed: Dec. 28, 2012

(65) Prior Publication Data

US 2014/0186785 A1 Jul. 3, 2014

(51) Int. Cl.
*F27D 9/00* (2006.01)

(52) U.S. Cl.
CPC ..... *F27D 9/00* (2013.01)

(58) Field of Classification Search
CPC ..... F27D 9/00; F23N 1/00; F23N 3/00; F23N 5/00; F23N 1/08; F24F 13/08
See application file for complete search history.

(56) References Cited

U.S. PATENT DOCUMENTS 2,987,788 A * 6/1961 Lyman ..... F27B 14/08 164/348
4,086,424 A 4/1978 Mellen, Sr.
4,423,516 A 12/1983 Mellen, Sr.
4,518,351 A 5/1985 Mellen, Sr.
4,753,192 A * 6/1988 Goldsmith ..... C23C 8/00 118/715
4,802,441 A * 2/1989 Waugh ..... C21D 1/84 118/666
4,830,342 A * 5/1989 Boneff ..... B22F 3/15 266/252
4,931,624 A 6/1990 Mellen, Sr.
4,968,009 A * 11/1990 Asari ..... F27D 9/00 266/249
4,979,896 A * 12/1990 Kinoshita ..... F27D 9/00 110/336
5,097,890 A * 3/1992 Nakao ..... C30B 25/10 118/724
5,878,191 A * 3/1999 Miyashita ..... H01L 21/67115 118/50.1
6,005,225 A * 12/1999 Kowalski ..... H01L 21/67098 118/50.1
6,155,341 A * 12/2000 Thompson ..... F24F 11/0079 165/244
6,567,267 B1 * 5/2003 Wang ..... H05K 7/20181 174/16.1
8,461,062 B2 * 6/2013 Sakai ..... C23C 16/405 118/696
2003/0089426 A1 * 5/2003 Poor ..... C21D 1/773 148/216
2003/0102103 A1 * 6/2003 Lombard ..... B22D 17/007 164/335
2004/0074978 A1 * 4/2004 Rosen ..... G06Q 50/06 236/1 C (Continued)

*Primary Examiner* — Jianying Atkisson
*Assistant Examiner* — Kun Kai Ma
(74) *Attorney, Agent, or Firm* — ZIP Law PLLC; Claire Zopf

(57) ABSTRACT

An active cooling system for a furnace that establishes steep temperature gradients, reduces temperature variations and performs rapid cooling, improving mechanical and electrical properties of heat-treated materials, increases overall throughput and promotes low compositional variation in the growth of crystals.

20 Claims, 17 Drawing Sheets

(56) References Cited

U.S. PATENT DOCUMENTS

2004/0105483 A1* 6/2004 Lian ..... F27B 14/04
373/140
2005/0121145 A1* 6/2005 Du Bois ..... C23C 16/45578
156/345.33
2006/0083495 A1* 4/2006 Taiquing ..... F27B 17/0025
392/416
2007/0147462 A1* 6/2007 Wilcox ..... F27B 5/04
373/113
2008/0124667 A1* 5/2008 Schultz ..... F23N 1/022
431/18
2008/0153314 A1* 6/2008 Hayashida ..... H01L 21/67109
438/795
2008/0296282 A1* 12/2008 Kobayashi ..... F27B 17/0025
219/385
2009/0095422 A1* 4/2009 Sugishita ..... C23C 16/4411
156/345.27
2010/0218724 A1* 9/2010 Okada ..... C23C 16/4405
118/724
2011/0223552 A1* 9/2011 Kobayashi ..... C23C 16/463
432/4
2012/0064469 A1* 3/2012 Yoshii ..... F27B 17/0025
432/24
2012/0064472 A1* 3/2012 Yoshii ..... F27B 17/0025
432/42
2012/0100722 A1* 4/2012 Asai ..... C23C 16/08
438/758
2012/0223066 A1* 9/2012 Yoshii ..... F27B 17/0025
219/390

* cited by examiner

300

$y_H$
$y_L$
Active cooling controller output (%)
Furnace controller output (%)
$x_L$
$x_H$
$x_M$
302
304
306

310

$y_H$
$y_L$
316
314
312
Active cooling controller output (%)
Furnace controller output (%)
$x_L$
$x_H$
$x_M$
302
304
306

FURNACE SYSTEM WITH ACTIVE COOLING SYSTEM AND METHOD

FIELD OF THE INVENTION

The present invention relates to an active cooling system for a furnace that may be a tube or temperature gradient furnace used in the annealing of metals, semi-conductors, ceramics and other materials and used substantially in crystal growth processes. The present invention is more specifically directed to an active cooling system for a furnace that establishes steep temperature gradients, reduces temperature variations and performs rapid cooling, improving mechanical and electrical properties of the heat-treated materials and promoting low compositional variation in the growth of crystals.

BACKGROUND OF THE INVENTION

Heat-treatment and temperature gradient furnaces are used in a number of production processes, such as for annealing of metals and ceramics, for annealing and oxidation processes for semiconductors, for "growing" of crystals, and for other heat-treatment material process applications. Temperature gradient furnaces commonly have a series of zones to control temperatures around the area of a workpiece to promote crystal growth or to promote particular mechanical or electrical properties within a material. Each material application process requires steep gradients in temperature and the holding of consistent temperatures over long periods of time with minimal variation to produce uniform properties within the material.

As an example, in an application to grow large-area single-crystals, the crystals commonly formed from a melt of crystalline material are placed in a refractory container or ampoule and heated within a furnace at a constant temperature until molten. The molten material is then cooled slowly at one end until crystallization starting from a single nucleation from the melt sets in. Currently, the cooling at the crystallization temperature must be done slowly and progressively along the length of the material, so that the crystal lattice can form entirely on the single nucleation so as to produce a single crystal. Optimum conditions for single crystal growth call for substantially steep and well-controlled temperature gradients that move relative to the material. Furnaces that produce fairly reliable temperature gradients are known, such as the furnace described in U.S. Pat. Nos. 4,518,351 and 4,423,516 issued to Robert H. Mellen, where the furnace uses a plurality of heating elements sandwiched between respective insulating layers to form temperature zones across the material workpiece. The temperature within each zone is set and maintained or ramped up to a prescribed temperature by powering the heating elements using feedback from thermal sensors within each zone to adjust power requirements and create temperature gradients through the zones of the furnace.

Temperature adjustments for each specific zone provide for a more accurate gradient in temperature within the area of the work. However, variations or ripple at set temperatures within the temperature gradient is one of a number of factors that affect the quality of the monocrystals or properties and uniformity of other heat-treated materials. It has been extremely difficult to produce large area, single-crystals or other heat-treated materials that have low compositional variation and homogeneous mechanical or electrical properties. A factor in producing the temperature gradient is related to loading of the heating elements, where unless a heating element is continually loaded, its response to control can be slow and erratic causing inconsistent temperature fluctuations and temperatures exceeding the prescribed temperature gradients. Another factor affecting composition and material properties is the problem of heat flowing radially from the axis of the temperature gradient within the furnace chamber. Such heat flow produces undesired temperature variations within planes perpendicular to the axis of the gradient. This can cause deleterious effects in crystal growth particularly along the interface of the crystal and ampoule where temperature variations may cause a concave shape with respect to the crystal. The concave interface shape may promote new grains to form causing growth to be inward towards the bulk of the crystal reducing compositional homogeneity. Additionally, current crystal growth process techniques and other heat-treatment material processes require lengthy periods to adjust gradients over small areas within the work region, where cooling of the heating elements may require hours. Additional time is also required to reduce the temperature of the furnace to move the workpiece to perform additional process steps or to remove the crystals or materials from the furnace.

Therefore, proper furnace design for a single temperature zone or multi-temperature zone furnace is a compromise between insulating capability and the ability to effectively change temperatures inside the furnace. A well-insulated furnace is capable of high temperature ramp rates in the positive direction, but in cooling, the same insulation that allows the furnace to heat up quickly, makes the furnace unable to cool quickly, specifically because of the increased insulation.

In contrast, a furnace that is designed to cool quickly will have little or no insulation, which allows the furnace to drop temperature quickly. However, in this furnace design it is difficult to ramp the temperature up quickly without significant increases in power. This additional power degrades the life of the heating elements causing the furnace to have a shorter operational life. Less insulation also dissipates significant amounts of heat into areas around the furnace requiring fans and air conditioning systems around the furnace units to maintain acceptable ambient temperatures. Alternately, a water cooling system may be used to dissipate the additional heat increasing both system and facility costs where plumbing and refrigeration to cool and pump the water through the furnace system is required.

Therefore, significant additional costs for cooling systems and facility infrastructures must be considered in using single temperature zone, multi-temperature zone or other furnace systems of the prior art. What is not known is a less costly and more effective cooling system for a well-insulated furnace that provides suitable temperature gradients, assists in maintaining minimal variations in temperature, and cools rapidly thereby increasing throughput in the production of heat-treated materials.

OBJECT AND SUMMARY OF THE INVENTION

In accordance with the invention, an active cooling furnace may have a single temperature zone or be provided with a plurality of individually controlled heating elements, each arranged symmetrically around the axis of the furnace chamber and layered sequentially with separating thermally insulating layers. In the multiple zone or electrodynamic gradient (EDG) furnace as an embodiment of the present invention, each heating element is positioned concentrically within a respective thermally conductive annulus that is loosely thermally coupled to the heating elements which are concentrically placed inside an insulating or heat dissipating medium. The heat dissipating medium is disconnected to the element with an airflow inlet path and outlet path concentrically symmetric through the insulating medium. Active cooling devices directed towards the airflow inlet are positioned along the furnace chamber where in a first embodiment each zone of the furnace includes an active cooling device. In operation, a temperature gradient is set using a prescribed process by manual entry or by using a software program from a computer system. Temperature sensors adjacent the heating elements provide data to the computer system to adjust the programmed temperatures over time to the desired gradients by controlling energy input to the individual heating elements.

In a first embodiment, the active cooling circuitry monitors the adjustment of input power to the heating elements from a furnace controller. Changes in input power may correspond to three states of heating, holding and cooling with the heat-treatment materials process. In a heating state where there is maximum power output to the heating elements of the furnace, the active cooling circuitry may slow or stop the cooling device to reduce heat dissipation within the furnace chamber. In a holding state, the active cooling circuitry may introduce a thermal load through the flowing of air around the furnace chamber to dissipate heat and maintain the amount of input power from the furnace controller in an accurately controllable range necessary to maintain the furnace chamber at a holding (target) temperature. In this state, in a first embodiment, the active cooling circuitry may adjust the rotation of the fans of the cooling device from moderate to ultra-low speeds to control airflow providing minimal airflow to reduce temperature variation resulting from continual adjustments in increasing and decreasing power to the heating elements thereby maintaining a smaller variation and more constant temperature. The airflow at ultra-low speeds is directed symmetrically around the furnace chamber, thereby drawing heat evenly away from the chamber and reducing hot or cold spots within the chamber. In a crystal growth application, by reducing temperature variations within the chamber, more constant temperatures at the interface of the crystal may be maintained thereby promoting a convex interface shape and preventing new grain formation improving the compositional homogeneity and electrical properties of the crystal.

At low or minimal power output from the furnace controller, the active cooling circuitry may drive the active cooling device at maximum speed to rapidly cool the furnace chamber, reducing cooling times from hours to minutes. The symmetrical airflow around the chamber at maximum speeds, draws heat both radially and axially away from the furnace chamber, dramatically increasing cooling times. Cooling times are reduced based on the size and dimensions of the furnace, where smaller furnaces may cool in under an hour where without active cooling from nine to ten hours would be needed. The improved cooling times provide for further process steps to be performed more quickly increasing heat-treated materials production.

An object of the present invention is an active cooling system that establishes steep temperature gradients in a furnace system.

Another object of the invention is an active cooling system that reduces temperature variations in a furnace system.

Another object of the invention is an active cooling system that performs rapid cooling in a furnace system.

A further object of the invention is an active cooling system for a furnace system that improves mechanical and electrical properties in heat-treated materials.

A still further object of the invention is an active cooling system for a furnace system that promotes low compositional variation in the growth of crystals.

The present invention is related to a method of actively cooling a furnace comprising the steps of acquiring a furnace controller output from a furnace controller, the furnace controller output corresponding to an amount of power provided to a heating element included in a furnace; and generating an active cooling control output based, at least in part, on the acquired furnace controller output, the active cooling control output configured to drive an active cooling element coupled to the furnace, the active cooling element configured to adjust a flow rate of a cooling medium in the furnace. The method of actively cooling a furnace is related to the furnace controller output by a predetermined transfer characteristic wherein the furnace controller output is less than a low threshold and the active cooling control output is at or near a maximum, corresponding to a maximum flow rate of the cooling medium configured to cool a zone of the furnace. The method of actively cooling a furnace is further related to a furnace controller output that is greater than a high threshold and the active cooling control output that is at or near a minimum, corresponding to a minimum flow rate of the cooling medium configured to facilitate temperature uniformity with a zone of the furnace.

The method of actively cooling a furnace is also related to the furnace controller output that is below a range of optimal power levels for the furnace and the active cooling control output that is at a value configured to allow the cooling medium to dissipate sufficient heat in a zone of the furnace to cause the furnace controller to increase furnace controller output to within the range of optimal power levels. The method of actively cooling a furnace includes the further steps of determining whether a process is completed based on a duration that the acquired furnace controller output is less than a low threshold where the low threshold maybe 5% and the maximum is 100%, or the high threshold is 50% and the minimum is 5% and the range of output power levels is 50% to 70%. The method of actively cooling a furnace further comprising the step of directing the cooling medium through a channel in the insulation of the furnace and around a heating element.

The present invention further relates to a furnace system with active cooling comprising active cooling control circuitry configured to acquire a furnace controller output from a furnace controller, the furnace controller output corresponding to an amount of power provided to a heating element included in a furnace, and an active cooling element coupled to the furnace, the cooling element configured to flow a cooling medium in a channel associated with a zone of the furnace and wherein the active cooling control circuitry is configured to generate an active cooling control output based, at least in part, on the acquired furnace controller output with the active cooling control output configured to drive the active cooling element to adjust a flow rate of the cooling medium.

The furnace system with active cooling includes active cooling control circuitry that comprises a processor configured to execute an active cooling application, and a memory coupled to the processor, the memory configured to store the active cooling application and a predetermined transfer characteristic configured to relate the active cooling control output to the acquired furnace controller output. In the furnace system with active cooling, the active cooling control output is configured to drive the active cooling element to achieve a maximum flow rate of the cooling medium when the acquired furnace controller output is less than or equal to a predetermined low threshold with the maximum flow rate of the cooling medium configured to cool an associated zone of the furnace. The furnace system with active cooling wherein the active cooling control output is configured to drive the active cooling element to achieve a minimum flow rate of the cooling medium when the acquired furnace controller output is greater than or equal to a predetermined high threshold with the minimum flow rate of the cooling medium configured to facilitate accurate temperature sensing in an associated zone of the furnace.

In the furnace system with active cooling, the active cooling control circuitry comprises a timer configured to provide a measure of a duration of time that the furnace controller output is equal to or less than a low threshold, a magnitude of the duration configured to differentiate between a cooling state within a process and a cooling state at a completion of the process. The furnace system with active cooling wherein the active cooling control output is configured to drive the active cooling element to change a flow rate of the cooling medium wherein the change of flow rate is inversely proportional to a change in the acquired furnace controller output when the acquired furnace controller output is less than or equal to a predetermined high threshold and greater than or equal to a predetermined low threshold, the change in flow rate of the cooling medium configured to facilitate maintaining a target temperature in a zone of the furnace.

Other objects and advantages of the present invention will become obvious to the reader and it is intended that these objects and advantages are within the scope of the present invention. To the accomplishment of the above and related objects, this invention may be embodied in the form illustrated in the accompanying drawings, attention being called to the fact, however, that the drawings are illustrative only, and that changes may be made in the specific construction illustrated and described within the scope of this application.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE DRAWINGS

Figure 1:
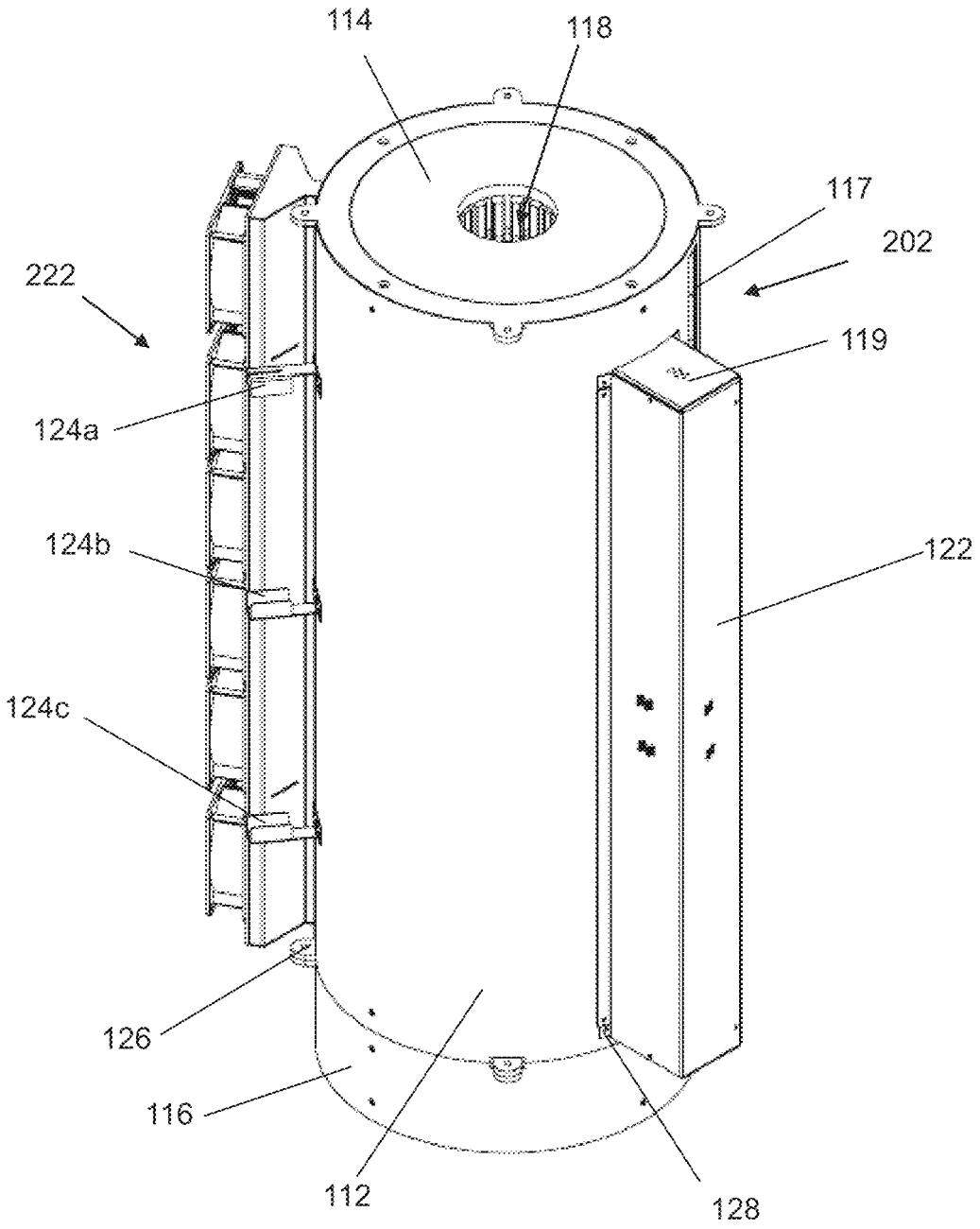
FIG. 1 is a perspective view of a furnace system with active cooling in a first embodiment of the present invention.

FIG. 1 shows a first embodiment of a furnace system with active cooling 202. The furnace has a shell 112, end cap 114 and vestibule 116 that encase a core assembly 118. The shell 112, end cap 114 and base 116 are made from stainless steel. The removable end cap 114 is secured to the shell 112 and may completely cover or only partially cover the furnace chamber opening dependent upon the requirements of the heat-treatment application. Affixed to the shell 112 are a series of active cooling elements 222 that form slots (not shown) through the shell 112 that extend through the insulation 180 of the core assembly 118 as described herein. A second series of slots 117 extend through the shell 112 on the opposing side of the furnace 202 as an exhaust from heat dissipated from the heater core assembly 130 using the active cooling system 206.

The electrical enclosure 122 includes electrical control and power supply connections for the furnace 202 and is attached to the shell 112 using stainless steel screws or other heat tolerant fixtures 128 with power connections extending through the shell 112 to connect to the components of the core assembly 118. The electrical enclosure 122 may have a series of vent holes 119 to dissipate heat from within the enclosure 122. A series of attachment flanges are provided 126 to attach a core assembly 118 of a separate heating zone to the shell 112 and to attach the shell 112 to the vestibule 116 of the furnace. The vestibule 116 supports the furnace in a vertical orientation. Alternatively, the furnace 202 may be supported in a horizontal or angular orientation dependent on the requirements of the heat-treatment application. In an embodiment of the present disclosure, the furnace 202 has a number of heating zones 215 to create temperature gradients that may move axially along the furnace chamber to promote crystal growth or heat treat different areas at different temperatures over a workpiece. Mounting brackets 124 are affixed to the shell 112 to support thermocouples or other temperature sensors that are positioned within each zone of the active cooling furnace 202.

Figure 2:
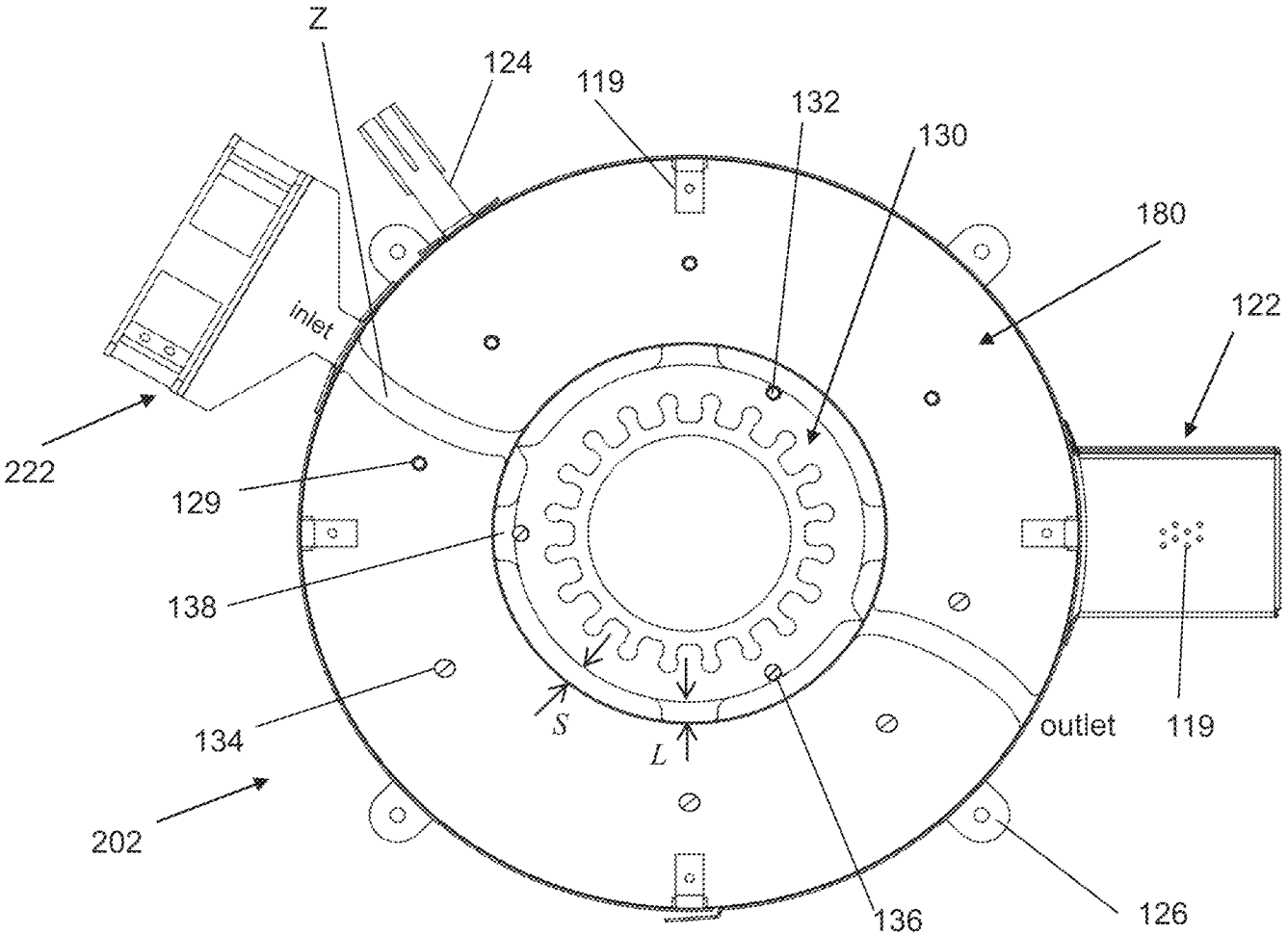
FIG. 2 is a top view of a furnace system with active cooling in a first embodiment of the present invention.

The active cooling furnace system 202 is a well-insulated furnace to provide steep gradients that rapidly increase temperature within the furnace chamber or heating zone 215 at lower power loads than less well-insulated furnaces. The furnace 202 may be of any size or dimension as required by the heat-treatment application with the amount of insulation dependent upon the temperature range requirements of the furnace 202. In a top view of without the end cap 114 installed, as shown in FIG. 2, the insulation 180 of the active cooling furnace 202 is formed with an air flow channel that surrounds the heater core assembly 130. The active cooling elements 222 are aligned with the air flow channel denoted as Z to direct flow from an inlet to the channel, around the heater core assembly 130 and to an outlet to assist in the dissipation of heat from the heater core assembly 130. The insulation 180 is assembled using a series of alignment pins 134 that extend through openings 129 in the insulation. The heater core assembly 130 is also assembled using alignment pins 136 that extend through openings 132 in the heater core assembly 130. The heater core assembly 130 is centered and isolated from the insulation 180 using concentric spacer tabs 138 that are of a dimension L to provide adequate air flow through the space S of the air channel Z and around the heater core assembly 130. Clip tabs 119 attached to the shell 112 may be used to secure the insulation 180 of the core assembly 118 to the shell 112.

Figure 3:
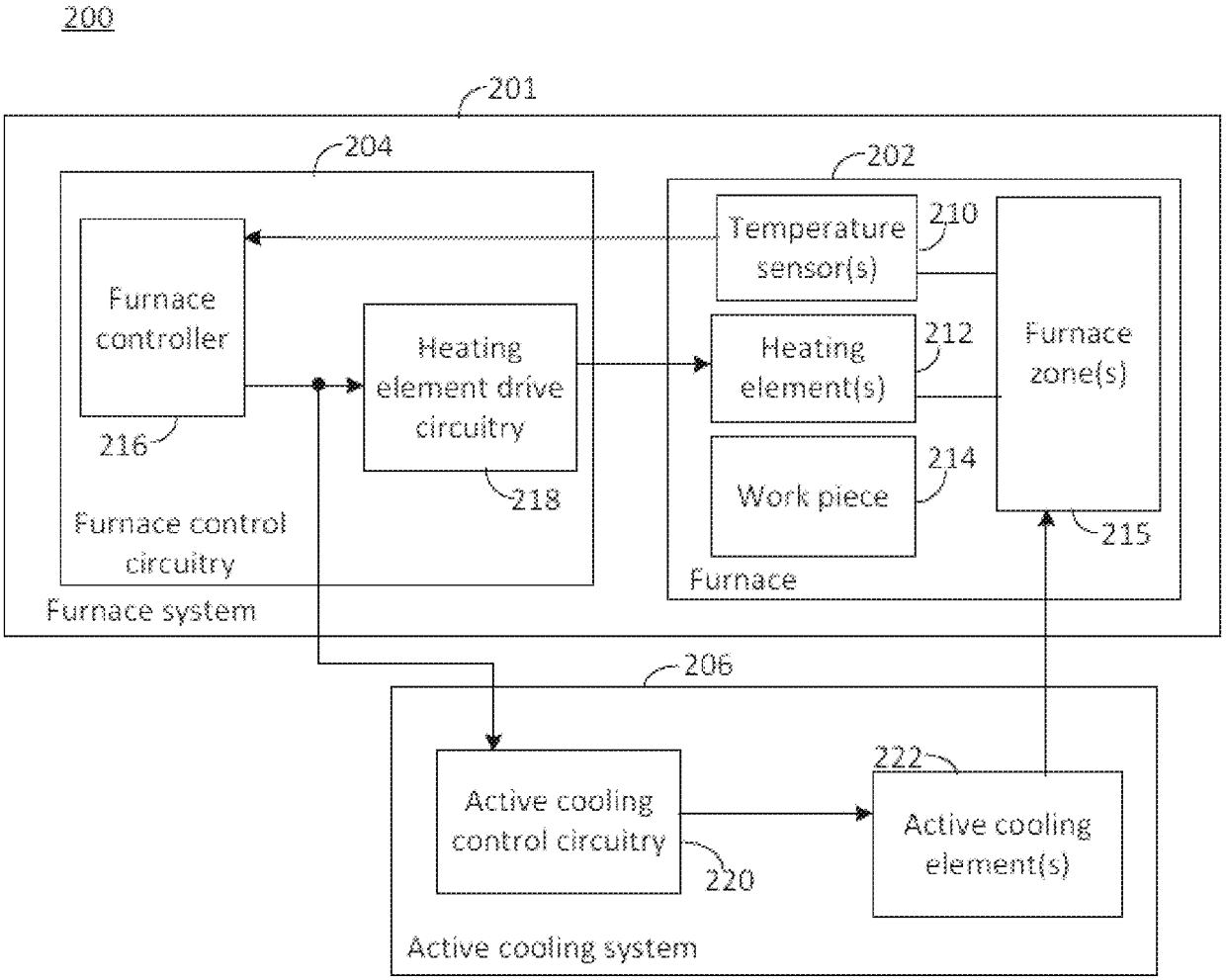
FIG. 3 is an exemplary system block diagram including a furnace system and an active cooling system, consistent with the present disclosure.

Active cooling system 206 includes active cooling circuitry 220 and the active cooling elements 222 that are shown in an exemplary system block diagram 200 of the system including furnace system 201, consistent with the present disclosure, as shown in FIG. 3. The furnace system 201 includes a furnace 202 and furnace control circuitry 204. Furnace 202 may include one or more zone(s) 215. Furnace 202 may also include one or more temperature sensor(s) 210 and one or more heating element(s) 212. The temperature sensor(s) 210 are configured to sense temperature(s) in the zone(s) 215 of furnace 202. At least one heating element may be associated with a respective zone. The heating element(s) 212 are configured to heat the zone(s) 215 of furnace 202 based, at least in part, on output(s) from furnace control circuitry 204.

Furnace control circuitry 204 includes furnace controller 216 and heating element drive circuitry 218. Furnace controller 216 is configured to monitor temperature(s) within the zone(s) 215 of furnace 202 and to provide furnace controller output, e.g., furnace control commands, to heating element(s) 212 based at least in part on process data and/or sensed temperature(s). Process data may include target zone temperature(s), rates of change of temperature(s) (i.e., temperature gradients), duration of holding zone(s) at temperature(s), etc., and may be based at least in part on a work piece 214 contained in the furnace 202. Temperature gradients may be relative to time and/or position within furnace 202. For example, a temperature gradient relative to position may correspond to differences in temperatures between a plurality of zones.

Thus, furnace control circuitry 204 is configured to provide closed loop control of the temperature(s) of the zone(s) 215 of furnace 202 based on sensed temperature(s) and target temperature(s). The target temperature(s) may be based, at least in part, on process data. The furnace system 201 has a plurality of operating states associated with controlling the temperature(s) of the zones(s) of furnace 202. The operating states include heating, holding and cooling. Heating corresponds to increasing the temperature of a zone, holding corresponds to maintaining the temperature in a zone to within a tolerance of a set (target) temperature and cooling corresponds to allowing the temperature in a zone to decrease. Cooling may occur during a process and/or at completion of a process. For example, a process may include a plurality of cycles that include heating, holding and/or cooling. Cooling during the process generally includes cooling to a target temperature greater than ambient. Cooling at completion of a process typically includes cooling to a temperature at or near ambient.

Furnace controller 216 is configured to provide furnace controller output (e.g., furnace control command(s)) to heating element drive circuitry 218. The furnace controller output may be determined based at least in part on the operating state, sensed temperature(s) and/or the target temperature(s) of the zone(s) of furnace 202. The heating element drive circuitry 218 is configured to drive the heating element(s) 212 in response to the furnace controller output. The heating element drive circuitry 218 may include, but is not limited to, thyristors, silicon controlled rectifiers (SCRs), solid state relays (SSRs) and/or other circuitry configured to drive a heating element based, at least in part, on a control input.

In some furnace systems, the furnace controller output may correspond to a voltage or a current level. In these systems, heating element drive circuitry 218 is configured as a linear power supply to the heating element(s) 212 (i.e., control is achieved based on an input level). In other furnace systems, the furnace controller output corresponds to a duty cycle of a pulse width modulated (PWM) waveform. Duty cycle corresponds to pulse width divided by waveform period. In these systems, heating element drive circuitry 218 is configured as a switching power supply to the heating element(s) 212 (i.e., control is achieved based on the duty cycle of the furnace controller output).

The furnace controller output is related to an amount of power provided to a heating element included in furnace 202. For example, the amount of power may be indicated by a percentage. In this example, relatively high furnace controller output (i.e., in the range of about seventy percent to one hundred percent) corresponds to maximum heating and relatively low furnace controller output (i.e., in the range of about ten percent to zero percent) corresponds to cooling. Some furnaces may have an optimal operating range for input power provided to heating element(s). The optimal operating range is typically less than 100% input power since driving heating elements at 100% power may shorten the lifetime of the elements. For example, input power in the range of 50% to 70% may be optimal. It may therefore be desirable to maintain input power within this range during heating and/or holding states for such furnaces. The actual amount of power may depend on characteristics of the furnace 202, heating element(s) 212 and/or drive circuitry 218.

In a typical furnace without an active cooling system, cooling is generally passive and occurs when the furnace controller output is at a minimum. For a relatively well-insulated furnace, cooling may take a relatively long time (e.g., over a period of hours) since not only the furnace zone(s) but also the insulation cools over time to allow the zones(s) to reach their target temperature(s). In a furnace with an active cooling system consistent with the present disclosure, active cooling element(s) are configured to flow a cooling medium through the channels, thereby dissipating heat in the zone(s) and reducing zone temperatures, independent of the insulation. Thus, a furnace configured with an active cooling system and associated channels consistent with the present disclosure may be relatively well-insulated for heating efficiency while also providing relatively rapid cooling (e.g., over a period of minutes).

Residual heat associated with the insulation may be utilized to enhance heating. In a relatively well-insulated furnace without an active cooling system, the insulation may cool completely during the extended cooling time typically required to passively achieve a target temperature. In contrast, for a furnace with an active cooling system consistent with the present disclosure, cooling times are dramatically reduced such that the insulation may not have cooled completely when the zone(s) reach their target temperature(s). The residual heat in the insulation may be utilized to assist heating furnace zone(s) by the active cooling system.

An active cooling system consistent with the present disclosure may be configured to enhance temperature sensing accuracy by temperature sensor(s) 210. For example, when the furnace 202 is in the holding and/or heating states, active cooling system 206 may be configured to provide sufficient flow of the cooling medium to ensure temperature uniformity over a zone so that an associated temperature sensor can accurately sense the temperature in the zone. The holding and/or heating states may correspond to a furnace controller output at or near a high threshold, as described herein. The flow rate may be configured to achieve temperature uniformity without significant heat dissipation. Without such flow, temperature sensor(s) 210 may not necessarily accurately detect zone temperature. Advantageously, more accurate temperature sensing may support more accurate process control by furnace controller 216. Target temperature undershoot when cooling, target temperature overshoot when heating and/or ripple when holding may be decreased with more accurate temperature sensing.

In some applications, the furnace may be configured for optimum operation with input power in a limited range, e.g., 50% to 70%. Furnaces are typically not operated near zero percent input power, i.e., are not completely powered down during a process. Likewise, furnaces are not typically operated at or near 100% as driving heating elements near 100% can significantly reduce their life. An active cooling system consistent with the present disclosure may be utilized to help maintain furnace input power in the range of 50% to 70% during heating and/or holding. Active cooling control circuitry may be configured to drive active cooling element(s) to introduce a thermal load (flow of cooling medium to dissipate heat) based on furnace controller output, as described herein. The thermal load may be adjustable by, for example, adjusting a flow rate of the cooling medium. For example, if the furnace controller output (corresponding to furnace input power) is less than 50% but within a tolerance, e.g., is 40%, and is not decreasing (i.e., is not indicating cooling state) then the active cooling system 206 may be configured to increase the flow of the cooling medium to dissipate heat and thereby reduce the sensed temperature in the zone. The furnace controller may then increase output to increase the zone temperature to its target temperature. In this manner, the active cooling system 206 may adjust the thermal load to facilitate maintaining the furnace controller output in the optimal range.

An active cooling system consistent with the present disclosure is configured to enhance temperature control of the zone(s) of furnace 202. When the furnace is in the cooling state, an active cooling system consistent with the present disclosure is configured to reduce a duration of a cooling time of one or more zone(s) from an initial temperature to a target temperature that is less than the initial temperature. Thus, an active cooling system consistent with the present disclosure is configured to increase the temperature gradient associated with cooling. For example, a cooling temperature gradient for a furnace system with an active cooling system may be about 60° C. per minute while the cooling temperature gradient for the same furnace system without the active cooling system may be only about 10° C. per minute. A net cooling time may be about twenty times faster for a furnace system with an active cooling system versus the furnace system without the active cooling system.

An active cooling system consistent with the present disclosure may be configured to reduce temperature variation(s) within a zone of furnace 202 that may be caused by an adjacent zone when the furnace control system is in the holding and/or heating states. For example, for a furnace that includes a plurality of zones, each zone may be held at a zone target temperature where the zone target temperatures differ between zones, thus creating a temperature gradient between the zones. The active cooling system 206 may facilitate maintaining, and/or may enhance, the temperature gradient by individually adjusting a thermal load for each zone. For example, the thermal load may be adjusted by adjusting active cooling controller output to the cooling element(s) associated with each zone to increase or decrease flow of the cooling medium in selected zone(s).

Active cooling system 206 includes active cooling control circuitry 220 and one or more active cooling element(s) 222. Active cooling element(s) may include, but are not limited to, fan(s) and/or pump(s). In some embodiments, the active cooling elements may include heat exchangers configured to enhance cooling. The type of active cooling element may depend on a type of associated cooling medium, e.g., air, a gas (e.g., argon, helium) and/or a liquid (e.g., water, coolant). The type of cooling medium may depend on process requirements and desired thermal characteristics of the cooling medium. The active cooling element(s) 222 may be positioned relative to furnace 202 and/or zones 215 within furnace 202. A subset of active cooling element(s) may be associated with a respective zone of a plurality of zones 215. For example, the active cooling element(s) 222 may include a plurality of fans positioned relative to furnace 202 and/or zone(s) 215 within furnace 202, as described herein.

Active cooling system 206 may be coupled to furnace control circuitry 204 and furnace 202. Active cooling control circuitry 220 is configured to acquire the furnace controller output provided to heating element drive circuitry 218 by furnace controller 216. Active cooling system 206 may be coupled to an existing furnace controller in order to acquire furnace controller output. Thus, active cooling system 206 may be coupled to furnace controller 216 in parallel with heating element drive circuitry. Active cooling system 206 is configured to operate, based at least in part, on furnace controller output without access to temperature sensor data.

Active cooling control circuitry 220 is configured to provide active cooling control output(s) to one or more of the active cooling element(s) 222 coupled to furnace 202. The active cooling control output(s) may be provided in response to active cooling command(s). The active cooling command(s) may be generated based, at least in part, on furnace controller output. The active cooling command(s) may be generated, based at least in part, on process data and/or active cooling parameters, as described herein. For example, the active cooling control output(s) may correspond to input power level(s) for one or more cooling fan(s). Similar to the furnace controller output, the active cooling control output may be indicated as a percentage. In this example, the input power level(s) are related to cooling fan speed(s) (e.g., in revolutions per minute (I)). For example, active cooling control output of 100% may correspond to maximum fan speed (i.e., maximum cooling). The cooling fan speed(s) are related to air flow (e.g., an amount of air flow in cubic feet per minute (CFM) produced by the fan). The amount of air flow is further related to fan characteristics, e.g., size.

Active cooling system 206 is configured to facilitate adjusting zone temperature(s) in response to furnace control command(s). Active cooling system 206 may enhance adjusting temperature(s) in one or more zone(s) of furnace 202 by controlling one or more active cooling element(s) 222 based on the furnace controller output. For example, active cooling control circuitry 220 may be configured to adjust the cooling fan speed based on furnace controller output and/or process data. The active cooling element(s) 222 may be adjusted, for example, using proportional, integral and/or derivative control methods.

When the furnace system 201 is in the holding state, furnace control circuitry 204 may be configured to drive the heating elements(s) 212 to maintain one or more zone temperature(s) within a tolerance (e.g. ±10%) of a predetermined set temperature for a predetermined holding time period. During the holding state, temperature(s) may decrease because of heat loss from furnace 202 when power to the heating element(s) 212 is decreased and may increase when power to the heating element(s) 212 is increased resulting in a variation ("ripple") in the zone temperature(s). Maintaining temperature(s) within the tolerance may be achieved by adjusting the voltage level and/or PWM pulse width of the furnace control output and/or duration of activation of selected heating element(s). Active cooling circuitry 220 may then control the active cooling element(s) (i.e., may adjust the thermal load) to facilitate maintaining the zone temperature(s) within the tolerance of the set temperature. For example, flow of the cooling medium may be controlled to enhance the accuracy of the temperatures sensed by the furnace controller 216 and temperature sensor(s) 210, as described herein.

Figure 4:
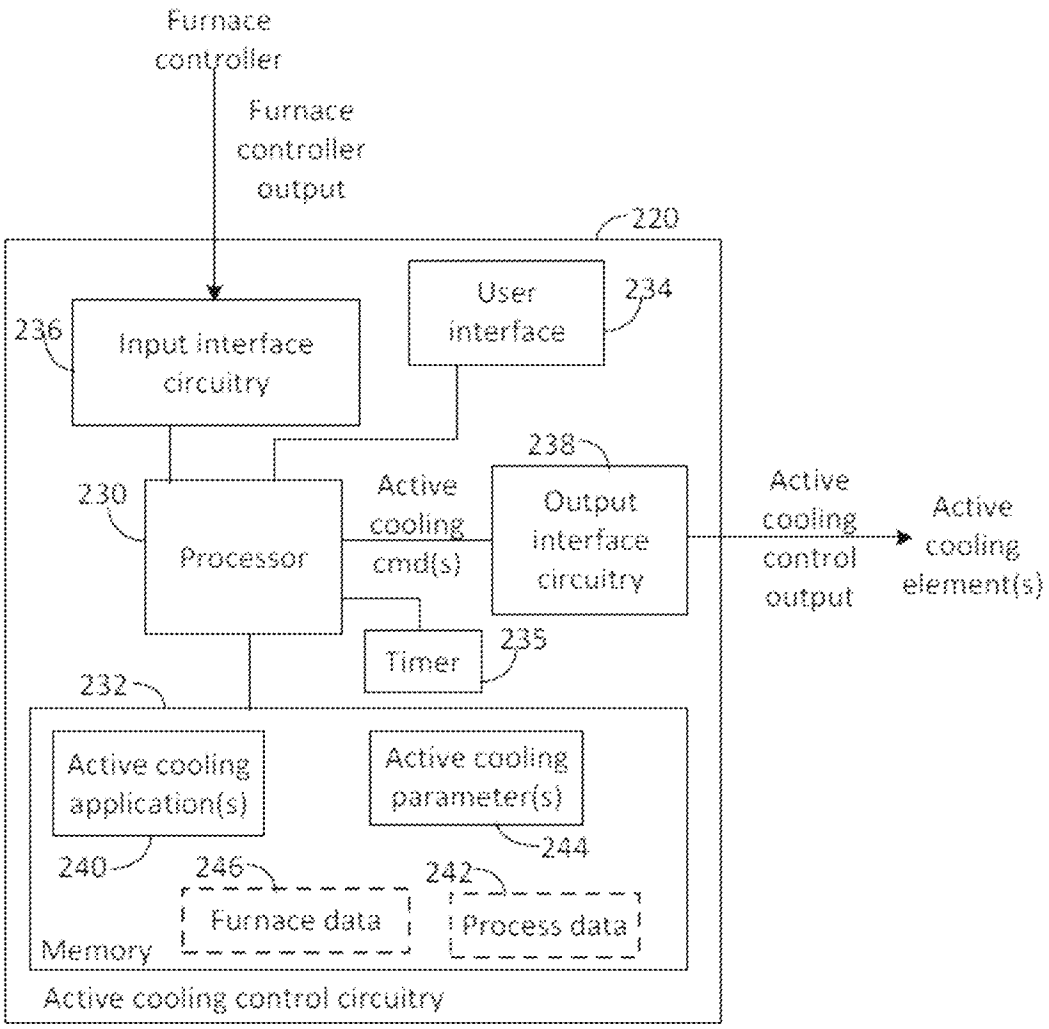
FIG. 4 is an exemplary system block diagram for the active cooling control circuitry depicted in FIG. 3 consistent with the present disclosure.

FIG. 4 is an exemplary system block diagram 220 corresponding to the active cooling control circuitry 220 depicted in FIG. 3, consistent with the present disclosure. The active cooling control circuitry 220 includes a processor 230, memory 232, a user interface 234, timer 235, input interface circuitry 236 and output interface circuitry 228. The processor 230 is configured to perform operations associated with the active cooling control circuitry 220 and active cooling system 206, as described herein. For example, processor 230 may be configured to execute active cooling application(s) 240.

The memory 232 is configured to store one or more active cooling application(s) 240, process data 242, one or more active cooling parameter(s) 244 and/or furnace data 246. Process data 242 may include target temperatures, time durations associated with holding temperatures, ranges of temperatures, desired temperature gradients (i.e., temperature profiles) relative to time and/or position (e.g., particular zone within a plurality of zones), tolerances and the like. Active cooling parameter(s) 244 may include a number of active cooling element(s), type of cooling element (e.g., cooling fans), cooling element characteristics (e.g., input power to fan speed (I) and/or air flow relationship, whether heat exchangers are present), cooling medium characteristic(s) and/or parameters associated with a transfer characteristic relating active cooling control outputs to furnace controller outputs. Transfer characteristic parameters include, but are not limited to, furnace controller output low threshold, furnace controller output high threshold, furnace controller output maximum, active cooling controller output corresponding to a cooling minimum, active cooling controller output corresponding to a cooling maximum and/or parameter(s) configured to specify the transfer characteristic for furnace controller outputs between the low threshold and the high threshold, as described herein. Furnace data 246 may include furnace control output characteristics (e.g., PWM or linear) and/or furnace configuration information (e.g., number of zones). In some embodiments, a subset of process data 242, active cooling parameter(s) 244 and/or furnace data 246 may be present. For example, the subset may include transfer characteristics relating active cooling control output to furnace controller output. In another example, the subset may include the transfer characteristics and the furnace configuration. In this example, if the furnace configuration includes a plurality of zones, a plurality of transfer characteristics may be included with each transfer characteristic corresponding to a respective zone. Process data 242, active cooling parameter(s) 244 and/or furnace data 246 may be stored at manufacturing and/or may be entered and stored by a user.

User interface 234 is configured to allow a user to enter and store process data 242, active cooling parameter(s) 244 and/or furnace data 246. User interface 234 may be configured to allow a user to monitor operation of the active cooling system 206. For example, user interface 234 may include a user input device (e.g., keyboard) and/or a display (e.g., a touch-sensitive display). In an embodiment, user interface 234 may be configured to communicate with a remote user. In this embodiment, user interface 234 may include a USB (universal serial bus) interface and/or an Ethernet-compatible interface. USB (Universal serial bus) may comply or be compatible with Universal Serial Bus Specification, Revision 2.0, published by the Universal Serial Bus organization, Apr. 27, 2000, and/or later versions of this specification. The Ethernet protocol may comply or be compatible with the Ethernet standard published by the Institute of Electrical and Electronics Engineers (IEEE) titled "IEEE 802.3 Standard", published in March, 2002 and/or later versions of this standard.

Timer 235 is configured to provide timing information to active cooling application 240. The timing information may be utilized to identify the state of furnace 202 and/or a zone 215 within furnace 202. The state may be identified based on a duration associated with the furnace controller output. For example, if the furnace controller output is greater than the high threshold for a first predetermined time period, then the state may correspond to heating. In another example, if the furnace controller output is varying within a tolerance of the high threshold for a second predetermined time period, then the state may correspond to holding. In another example, if the furnace controller output is decreasing at a predetermined rate, the state may correspond to cooling. The state may be utilized in determining whether and how much to adjust a thermal load, as described herein.

The timing information may be utilized to determine whether a process is complete. For example, if the state is identified as cooling, the cooling may be associated with a target temperature within a process or may be associated with cooling to ambient indicating that the process is complete. Cooling to a target temperature within a process may be differentiated from cooling to ambient based on a duration of the cooling state. A duration in the cooling state greater than a third predetermined time period may indicate the process is completed. The active cooling control circuitry 220 may then be configured to deactivate the cooling elements after a fourth predetermined time period. The fourth predetermined time period is configured to allow the furnace 202 and/or work piece 214 to cool to at or near ambient.

Input interface circuitry 236 is configured to capture furnace controller output and to convert the captured commands into data that may be stored in memory 232 and/or processed by processor 230. For example, input interface circuitry 236 may include an analog to digital converter. In another example, input interface circuitry 236 may include a counter configured to detect duration of a pulse and/or a waveform period of a PWM waveform.

Output interface circuitry 228 is configured to convert processor 230 output, i.e., active cooling element commands, into active cooling control outputs. Output interface circuitry 228 may include, but is not limited to, drive circuitry (e.g., a silicon controlled rectifier (SCR), thyristor, solid-state relay (SSR), power transistor, etc.). Output interface circuitry 228 is configured to convert a relatively low power input (e.g., logic level) into a relatively higher power output. For example, the output interface circuitry 228 may be configured to drive a fan motor included in an active cooling element. In another example, the output interface circuitry may be configured to drive a pump motor included in an active cooling element. A magnitude of the power provided to the fan motor or pump motor (i.e., active cooling control output) is related to the furnace controller output, as described herein, and may be related to process data 242, active cooling parameter(s) 244 and/or furnace data 246. A flow rate of the cooling medium is related to the active cooling control output and the associated rotational speed of the fan motor or pump motor.

Figure 5A:
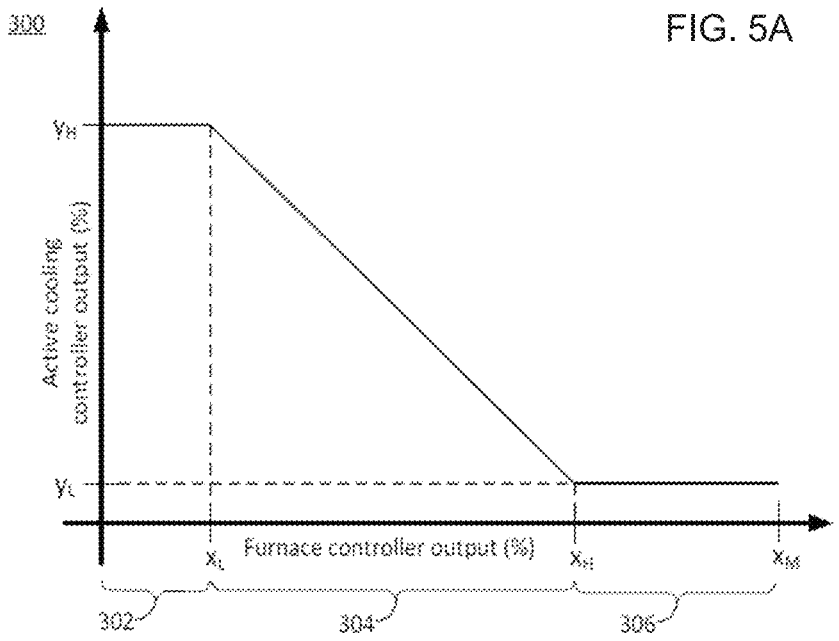
FIGS. 5A and 5B are plots of exemplary relationships between furnace controller output and active cooling control output, consistent with the present disclosure.

FIG. 5A is a plot 300 of an exemplary relationship (transfer characteristic) between furnace controller output and active cooling controller output, consistent with the present disclosure. In this example, the transfer characteristic includes three regions 302, 304, 306. The first region 302 corresponds to furnace controller output less than or equal to a low threshold xL. The second region 304 corresponds to a furnace controller output greater than or equal to the low threshold xL and less than or equal to a high threshold xH. The third region corresponds to a furnace controller output greater than or equal to the high threshold xH and less than or equal to a furnace controller output maximum xM. The low threshold xL is less than the high threshold xH and the high threshold xH is less than or equal to the maximum xM. Although three regions are shown, more or fewer regions may be defined, within the scope of the present disclosure.

The first region 302 corresponds to maximum cooling, i.e., maximum flow of the cooling medium. The third region 306 corresponds to minimal flow of cooling medium. The second region 304 corresponds to adjustable (variable) thermal load based at least in part on furnace controller output. For furnace controller outputs in the first region 302, (i.e., ≤xL), active cooling controller output is at or near a cooling maximum yH. For example, for fan type active cooling elements, the cooling maximum yH may correspond to a maximum fan speed and maximum air flow. Similarly, for furnace controller outputs in the third region 306 (i.e., ≥xH), active cooling controller output is at or near a cooling minimum yL. The cooling minimum may correspond to a minimum fan speed and minimum air flow. In an embodiment, the minimum fan speed may be zero. In another embodiment, the minimum fan speed may be ultra-low. Ultra-low corresponds to fan speeds configured to provide air flow in the range of 1 CFM (cubic feet per minute) to 10 CFM. Ultra-low fan speeds may be configured to facilitate temperature sensing accuracy, as described herein. In this example, for furnace controller outputs in the second region 304 (i.e., between xL and xH), the active cooling controller output is linearly related to the furnace controller output. In other words, a change in furnace controller output results in an inversely proportional change in an active cooling control output.

The state of the furnace 202 and/or one or more of the zone(s) 215 may be related to one or more of the regions 302, 304, 306. The state may not be uniquely related to a region. In other words, states may overlap regions. For example, the cooling state may correspond to the first region 302, where the furnace controller output is less than the low threshold xL. The heating state may correspond to at least a portion of the third region 306 and to a portion of the second region 304. Similarly, the holding state may correspond to a portion of the third region 306 and a portion of the second region 304. Independent of the state, FIG. 5A illustrates an example relationship (i.e., transfer characteristic) between the furnace controller output and the active cooling control output.

The furnace controller output low threshold xL and/or high threshold xH may be user-defined. The furnace controller output maximum xM may depend on the particular furnace. The low threshold xL and high threshold xH may be related to other active cooling parameter(s), furnace data and/or process data. For example, the furnace controller output low threshold xL may be set at or near 5% and the furnace controller output high threshold xH may be set at or near 50%. In this example, the maximum furnace controller output xM may be at or near 70%. Particular values of xL, xH, yL and yH may depend on a particular process characteristics. Thus, for the transfer characteristic illustrated in FIG. 5A, active cooling parameter(s) may include xL, xH, xM, yL, yH and characteristic(s) (e.g., linear) associated with the second region 304 of the transfer characteristic. A slope and y-intercept of the linear portion of the transfer characteristic may be determined based, at least in part, on xL, xH, yL and yH.

Figure 5B:
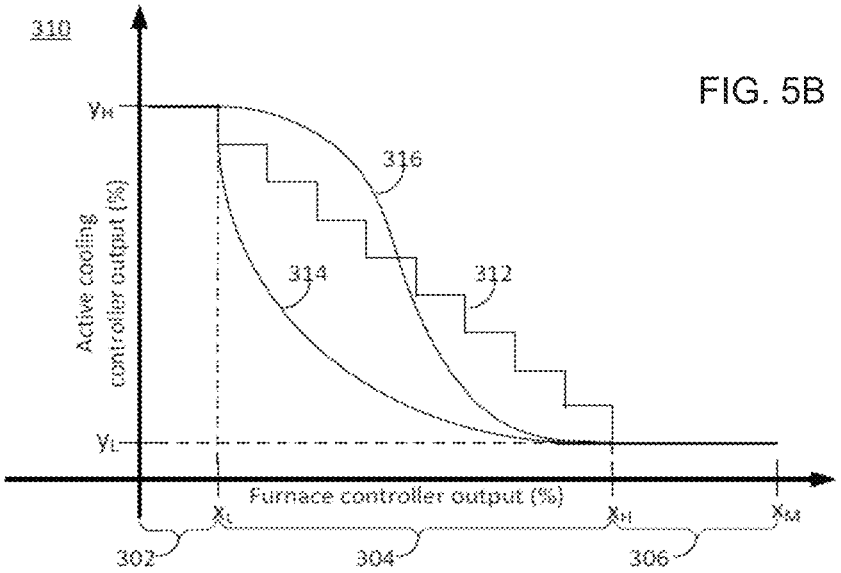

FIG. 5B illustrates plots 310 of a plurality of exemplary transfer characteristics. In these examples, the transfer characteristics in the second region 304 are non-linear. A first transfer characteristic 312 illustrates a generally discrete second region 304 with one active cooling controller output value corresponding to a range of furnace controller output values. A second transfer characteristic 314 illustrates a generally exponential decay second region 304. A third transfer characteristic 316 illustrates a transfer characteristic with relatively smaller magnitude slopes near the low threshold xL and the high threshold xH. The transfer characteristics illustrated in FIGS. 5A and 5B are some examples of transfer characteristics relating a furnace controller output to an active cooling control output. Other transfer characteristics may be implemented, based on user selections, furnace data, process data and/or other active cooling parameter(s).

Thus, active cooling control output may be adjusted based, at least in part, on furnace controller output and according to a predefined transfer characteristic. In this manner, active cooling element(s) may be controlled to enhance cooling in a relatively well-insulated furnace. Overshoot, undershoot and/or ripple in zone temperatures may be reduced by controlling active cooling elements to enhance temperature sensing accuracy, as described herein. This functionality may be achieved without direct access to zone temperatures by the active cooling system. An active cooling system consistent with the present disclosure may be added to an existing furnace controller by coupling to existing furnace controller output(s) and without coupling to existing temperature sensor(s).

Thus, active cooling control circuitry 220 is configured to capture furnace controller output and to control (e.g., drive) active cooling element(s) 222 based, at least in part, on the captured data, process data 242, active cooling parameter(s) 244 and/or furnace data 246. For example, during furnace cooling, selected active cooling elements associated with one or more zone(s) may be driven to enhance cooling (e.g., relatively high fan or pump I and, thus, relatively high cooling medium flow) and shorten a transition time from a relatively higher temperature (e.g., 1200° C.) to a relatively lower temperature (e.g., 800° C.). In another example, during maintenance of one or more selected zone(s) at respective temperatures (i.e., furnace system 201 in the holding state), active cooling element(s) associated with the selected zone(s) may be driven to reduce temperature variation (e.g., relatively low fan I, i.e., ≤30 I) within the zone(s) (and thereby enhance temperature sensing accuracy in the furnace control system) and/or to maintain a temperature gradient between zones.

In this manner, a relatively well insulated furnace may be cooled relatively quickly by controlling flow rate of a cooling medium. An active cooling system consistent with the present disclosure is configured to reduce overshoot, cool relatively quickly while minimizing undershoot and to manage temperature gradients between zone(s), as described herein. Selected active cooling element(s) may be activated, configured to allow cooling only in selected zone(s) and minimizing cooling in unselected zone(s) thus providing stable temperature gradients between zones. Specific temperature profiles may be implemented. Temperature profiles may be implemented relative to position (i.e., zone) within a multi-zone furnace and/or relative to time over a duration of a process. Further, an active cooling system consistent with the present disclosure may be utilized to control radial temperature gradients by altering heat flow in zone(s) of the furnace, as described herein.

Figure 6:
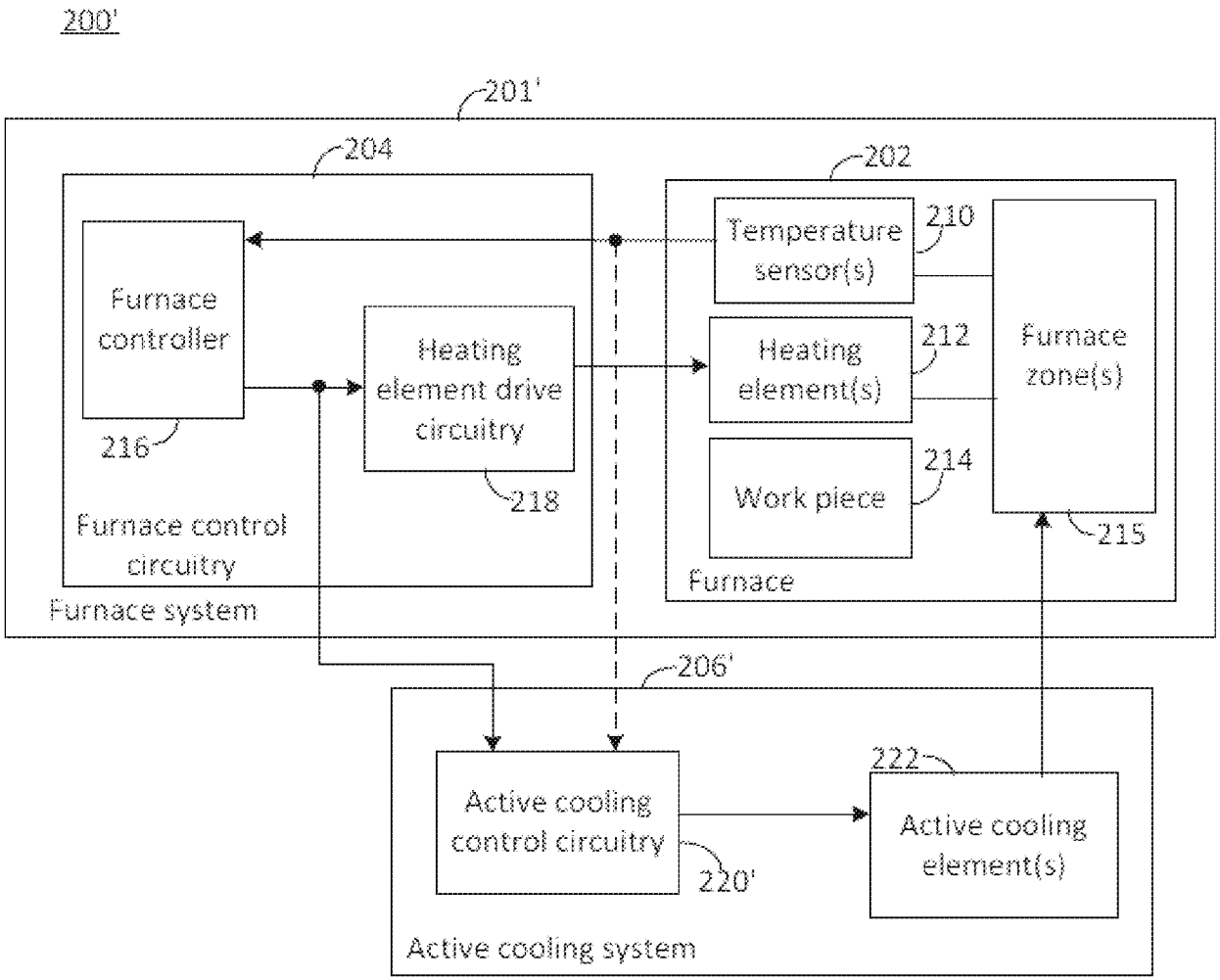
FIG. 6 is an exemplary system block diagram including a furnace system and an active cooling system including temperature sensing, consistent with the present disclosure.
Figure 7:
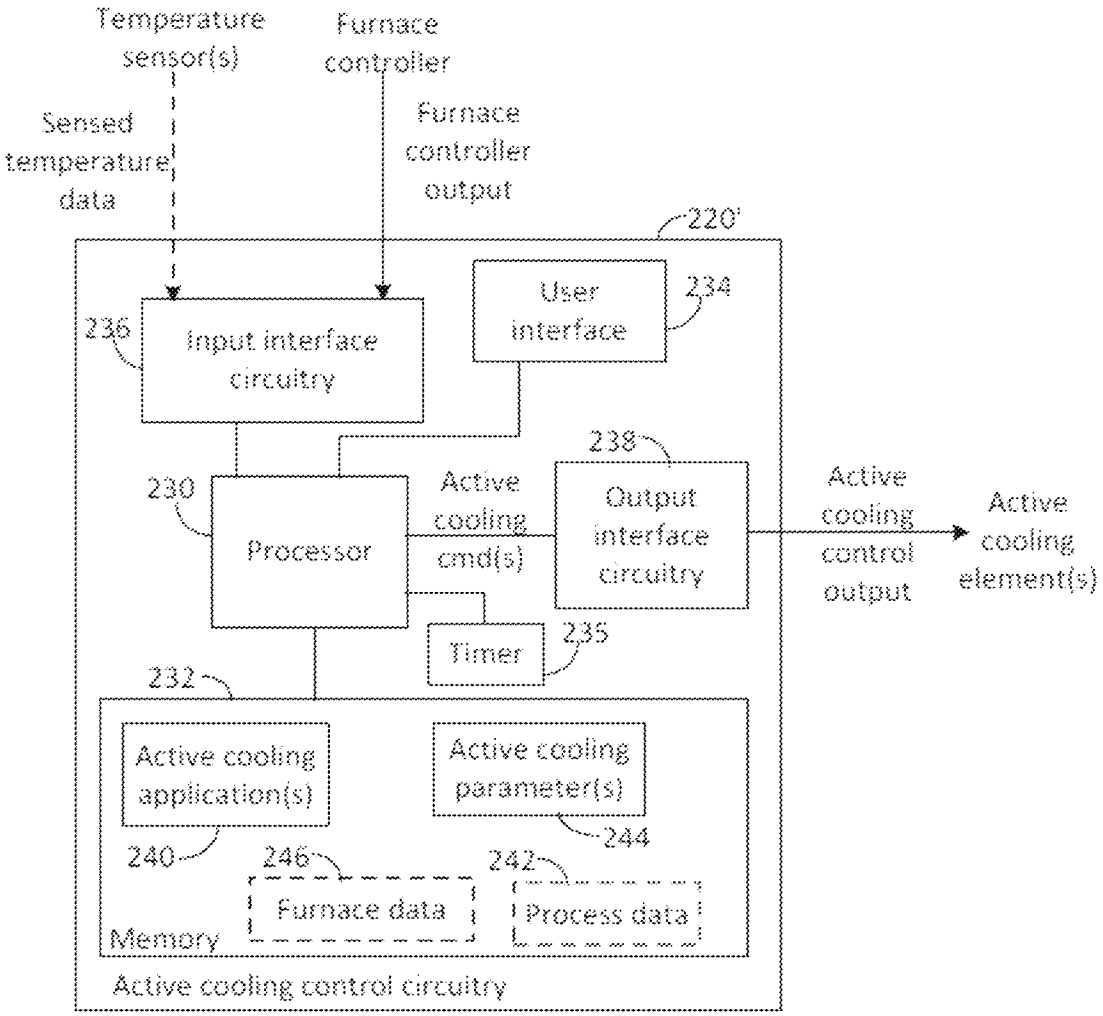
FIG. 7 is an exemplary system block diagram for the active cooling control circuitry depicted in FIG. 6, consistent with the present disclosure.

It should be noted that while temperature sensor data may be used, temperature sensor data is not required for operation of an active cooling system consistent with the present disclosure. FIGS. 6 and 7 illustrate a furnace system 200' with an active cooling system 206' and active cooling circuitry 220' configured to acquire temperature sensor data. Like elements have like reference designators. For example, active cooling control circuitry 220' may be configured to acquire temperature sensor data from temperature sensor(s) 210. The active cooling control circuitry 220' may be configured to drive the active cooling element(s) 222 based, at least in part, on the temperature sensor data. For example, temperature data may include a voltage corresponding to sensed temperature. The active cooling element command(s) may be generated based, at least in part, on acquired temperature sensor data.

Figure 8:
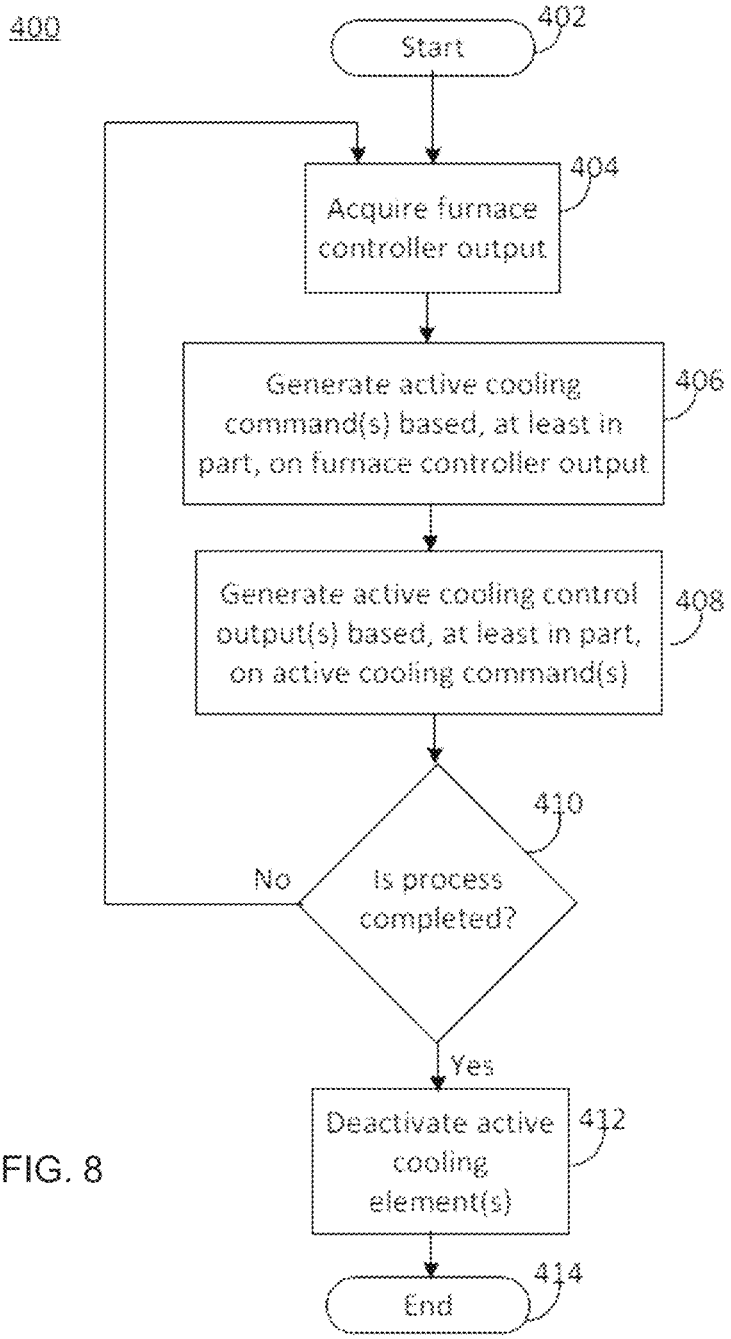
FIG. 8 is a flowchart of exemplary operations for an active cooling system consistent with the present disclosure.

FIG. 8 is an exemplary flowchart 400 for an active cooling system consistent with the present disclosure. The operations of flowchart 400 may be performed, for example, by active cooling system 206. In particular, flowchart 400 depicts exemplary operations configured to enhance process control in a relatively well-insulated furnace. The exemplary operations of flow chart 400 are configured to facilitate relatively rapid cooling, more accurate temperature sensing, operation of a furnace at optimal power levels and/or maintaining temperature gradients between zones in a multi-zone furnace.

Flow may begin at operation 402. It is assumed that process data 242, active cooling parameter(s) 244 and/or furnace data 246 have been stored prior to start 402. Furnace controller output (e.g., commands) may be acquired at operation 404. An active cooling command may be generated at operation 406 based, at least in part, on the acquired furnace controller output. The active cooling command may be further based, at least in part, on one or more active cooling parameter(s). For example, the active cooling command may be determined by applying an appropriate transfer characteristic to the acquired furnace controller output. Operation 408 includes generating active cooling control output(s) based, at least in part, on active cooling commands. For example, the commands may be configured to adjust fan speed(s) of one or more cooling fan(s) where the fan speed(s) are related to a value of the active cooling control output. The fan speed(s) are related to cooling medium flow (e.g., air and/or gas) rate in the channels of a furnace, as described herein. Whether the process is completed may be determined at operation 410. For example, whether the process is completed may be determined based, at least in part, on the furnace controller output and a duration associated with the furnace controller output. In this example, the duration may be configured to differentiate between cooling during a process and cooling to ambient at the completion of the process. If the process has not completed, program flow may return to operation 404. If the process has completed, active cooling element(s) may be disabled at operation 412. For example, power to the cooling fan(s) may be removed. Program flow may then end at operation 414.

Thus, the active cooling system is configured to facilitate cooling when the furnace system is in the cooling state and/or to provide an adjustable thermal load when the furnace is in the heating and/or holding states. The active cooling system may be configured to enhance temperature gradient control over a work piece by controlling individual active cooling elements (e.g., cooling fans).

"Circuitry", as used in any embodiment herein, may comprise, for example, singly or in any combination, hardwired circuitry, programmable circuitry such as computer processors comprising one or more individual instruction processing cores, state machine circuitry, and/or firmware that stores instructions executed by programmable circuitry. For example, circuitry includes, but is not limited to, a microcontroller, an application-specific integrated circuit (ASIC), a field-programmable gate array (FPGA) and/or a system on a chip (SoC).

"Memory", as used in any embodiment herein, may comprise, for example, read-only memories (ROMs), random access memories (RAMs) such as dynamic and static RAMs, erasable programmable read-only memories (EPROMs), electrically erasable programmable read-only memories (EEPROMs), flash memories and/or Solid State Disks (SSDs).

Any of the operations described herein may be implemented in a system that includes one or more storage mediums having stored thereon, individually or in combination, instructions that when executed by one or more processors perform the methods. The storage medium may include any type of tangible medium, for example, any type of disk including hard disks, floppy disks, optical disks, compact disk read-only memories (CD-ROMs), compact disk rewritables (CD-RWs), and magneto-optical disks, semiconductor devices such as read-only memories (ROMs), random access memories (RAMs) such as dynamic and static RAMs, erasable programmable read-only memories (EPROMs), electrically erasable programmable read-only memories (EEPROMs), flash memories, Solid State Disks (SSDs), magnetic or optical cards, or any type of media suitable for storing electronic instructions. Other embodiments may be implemented as software modules executed by a programmable control device. The storage medium may be non-transitory.

Figure 9:
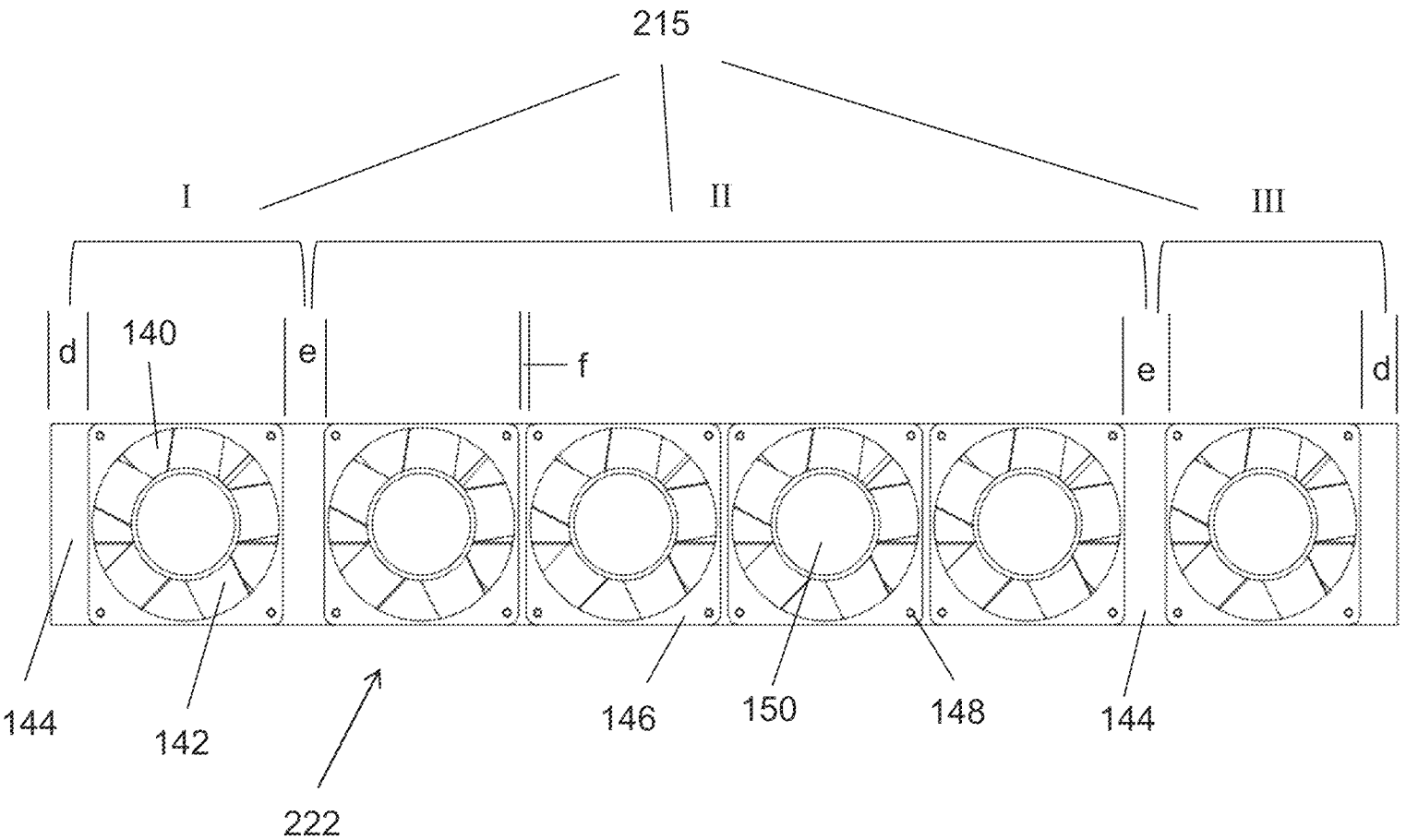
FIG. 9 is an elevation view of a first embodiment of an active cooling device in a first embodiment of the present invention.

In a first embodiment the active cooling elements 222 are a series of fans 140 that are attached to the furnace 202 along a slot formed through the shell 112 at the inlet to the air passage channel Z. The fans 140 may be of any size, dimension and power rating to meet the air flow requirements of the temperature ranges of the furnace 202. Fans of 1" to 3" with paddle, curved, or twisted blades 142 may be adequate for smaller furnace systems with the series of fans 140 aligned to the zones 215 of the furnace 202 as shown in FIG. 9. In an embodiment, the furnace 202 may have a first and third zone I and III that is of a shortened length to the central zone II. The fans 140 are inserted through a mounting frame 144 that spaces the fans 140 between the zones 215 with increased space e between each zone, minimal space f between the fans 140 within a single zone, and limited space d at each end of the mounting frame 144. Any arrangement of fans 140 may be adequate with some zones having no fans and other zones having multiple fans.

Figure 10:
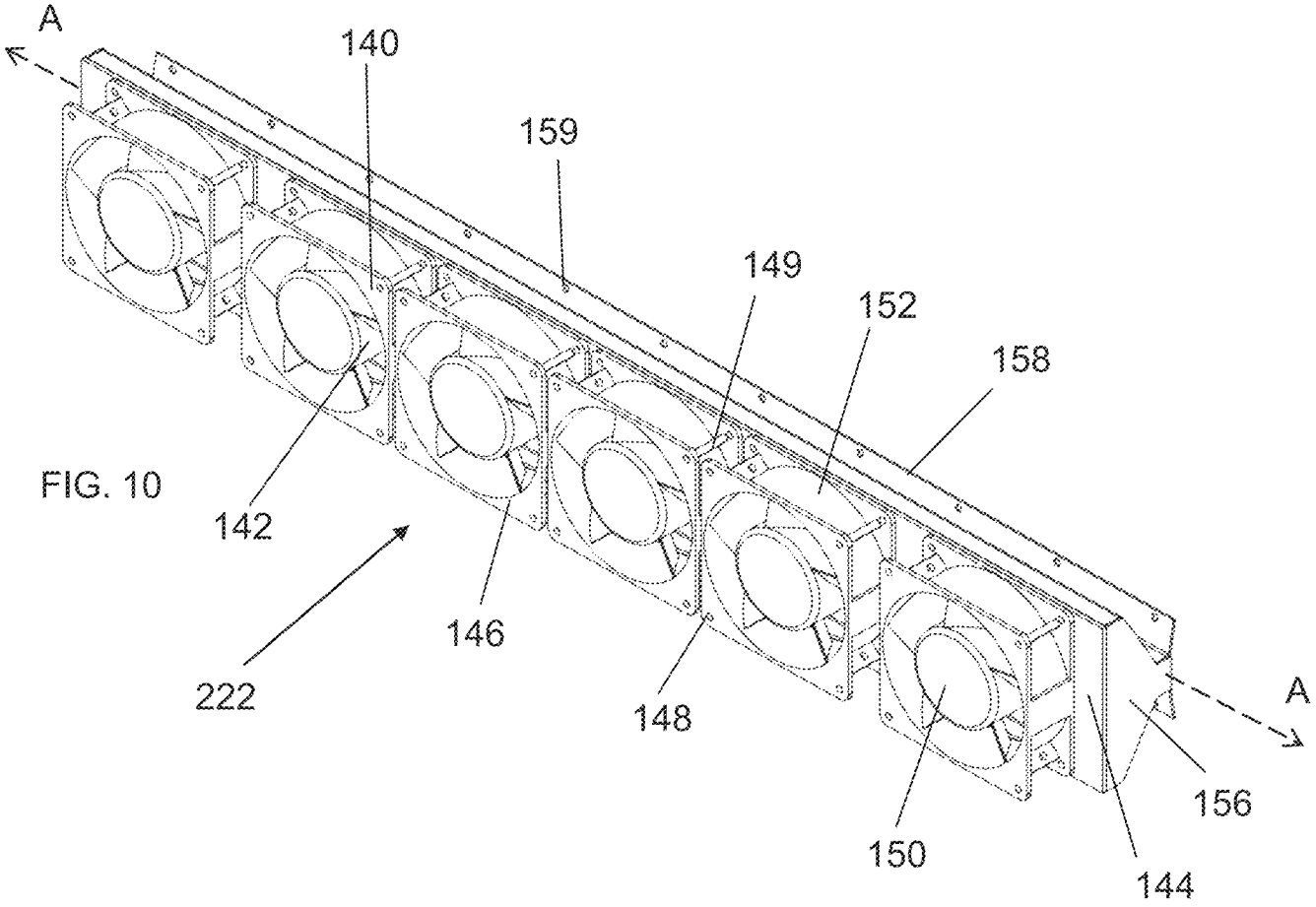
FIG. 10 is a perspective view of a first embodiment of an active cooling device in a first embodiment of the present invention.

The fans may have separate brackets 146 that are then attached to the mounting frame 144 using screws 148 or other attachment fixtures. The center of each fan may have an opening or a cap 150 to secure the fan blades 142. The attachment screws 148 may extend through tubular supports 149 to secure each fan 140 to the mounting frame 144 as shown in FIG. 10. Each fan 140 may also have an enclosure 152 around the fan blades 142 to direct air flow from the fan 140 into a funnel bracket 156. The funnel bracket 156 is attached to a mounting bracket 158 that has a series of holes 159 for attachment to the shell 112 of the furnace 202. The mounting bracket 158 may be slightly curved to accommodate the curvature of the furnace 202 and prevent leakage from the attachment of the mounting bracket 158 to the shell 112. The mounting bracket 158 is affixed axially (shown as axis A) along the furnace although in further embodiments the active cooling elements 222 may be mounted at an upper or lower area perpendicular to axis A with one or more active cooling elements 222 or sets of active cooling elements 222 positioned concentrically around the furnace 202. Adequate mounting frames and brackets may be fashioned to accommodate various orientations of the active cooling elements 222.

Figure 11:
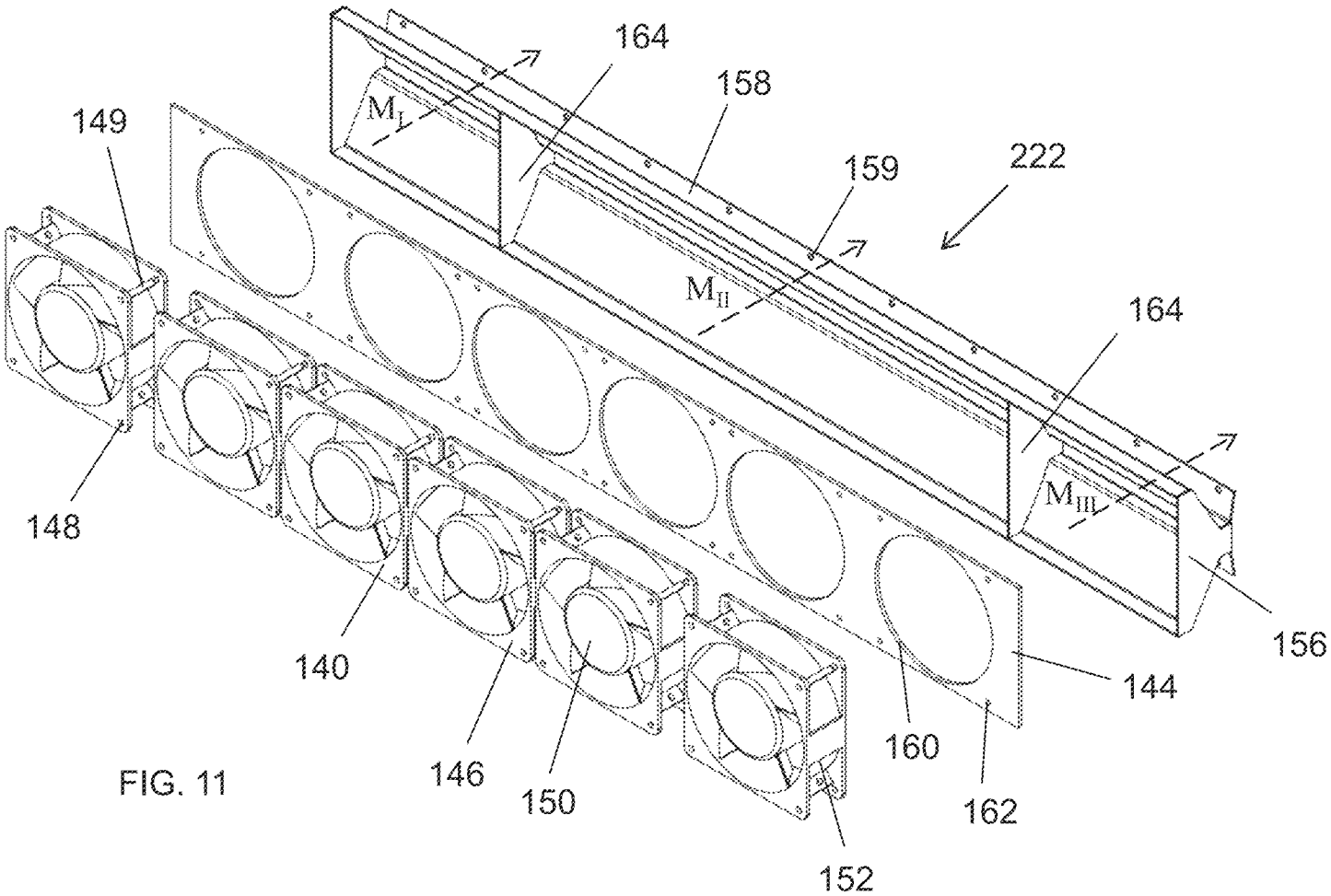
FIG. 11 is an exploded view of a first embodiment of an active cooling device in a first embodiment of the present invention.
Figure 12:
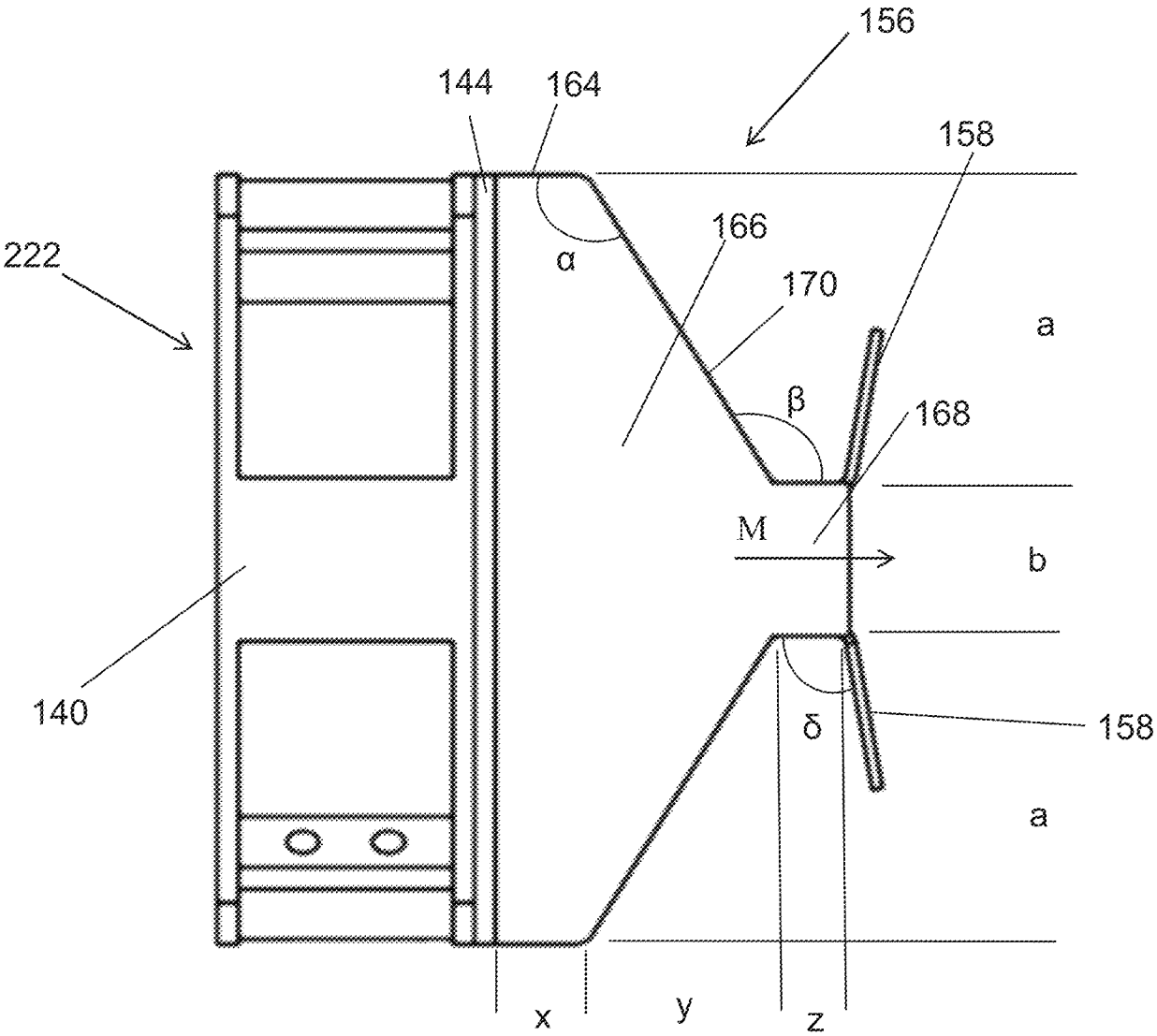
FIG. 12 is a side view of a first embodiment of a funnel bracket of the active cooling device of FIG. 11 in a first embodiment of the present invention.

As shown in an exploded view in FIG. 11, the mounting frame 144 has a series of cutouts 160 and attachment holes 162 to secure the fans 140 to the frame 144 and the frame to the funnel bracket 156. The funnel bracket 156 directs air flow from the fans through a series of slots $M_I$, $M_{II}$, and $M_{III}$ for each temperature zone 215 that mate with slots formed in the furnace shell 112. Funnel barriers 164 are positioned between each slot $M_I$, $M_{II}$, and $M_{III}$ to isolate air flow to a specific zone 215. The active cooling circuitry 220 provides for operation of only one fan 140 or set of fans within a single 215 or within one or more zones 215. The funnel bracket 156, as shown in FIG. 12, has a series of angles and rounded edges to create laminar flow through the bracket 156 and to the Z channel within the furnace 202. The funnel bracket 156 is formed with a short extension 164 at a minimal distance x that is then rounded through angle $\alpha$ to smoothly direct flow from the outer edges of fan blades 142 to the extended funnel portion 166 that extends a lengthened distance y and narrows to slot 168 at a shortened distance z. The obtuse angle $\beta$ and widened funnel distance a provides for uniform air flow along the rear funnel surface 170 and out and through slot 168. A curvature or slight angle $\delta$ reduces gaps and leakage at the attachment of the mounting bracket 158 to the furnace shell 112. The slot distance b may be of any adequate width to accommodate the required air flow based on the temperature range requirements of the furnace 202.

Figure 13:
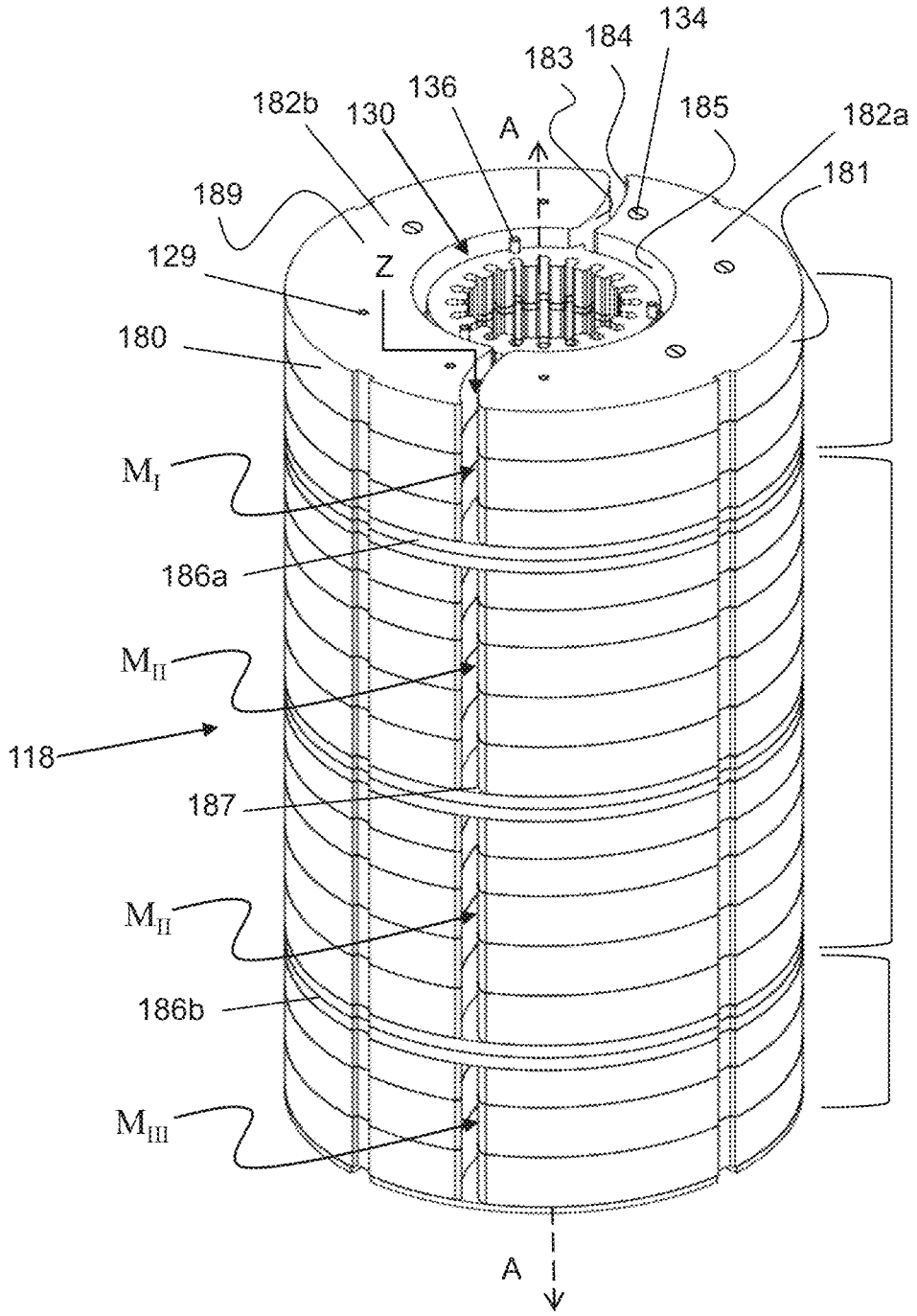
FIG. 13 is a perspective view of a first embodiment of a core assembly of the furnace system with active cooling in a first embodiment of the present invention.

A slot (not shown) formed in the shell 112 is aligned with the slot 168 of the active cooling system 222 and with the inlet to the air channel Z formed in the insulation 180 of the core assembly 118 as shown in FIG. 13. Air flow $M_I$, $M_{II}$, and $M_{III}$ from each slot 168 is directed to each temperature zone 215 formed within the core assembly 118. The temperature zones I, II and III are formed from layered insulation disks 180 surrounding the isolated heater core assembly 130. Each disk 180 is formed from complimentary pairs of semi-circular directional air flow segments 182*a* and 182*b* that partially surround the heater core assembly 130. The disk segments 182*a* and 182*b* have a rounded outer edge 181 that supports the furnace shell 112. The mating edges of the disk segments 182*a* and 182*b* are formed as convex 183 and concave 184 arcs that extend from the rounded outer edge 181 to a rounded inner edge 185 that is offset by space S from the heater core assembly 130. The arc shape of the mating surfaces 183 and 184 direct laminar flow from the slot 168 at the inlet to the air channel Z, around the heater core assembly 130, and out through the outlet without sharp edges or barriers that would restrict air flow across axis A of the furnace. While any linear or non-linear flow paths are contemplated within the scope of the present invention, improved performance has been achieved using the non-linear arced flow paths.

A temperature zone 215 is formed by layering a prescribed number of directional air flow disks 180 between one or more insulation rings 186 that are placed on the surface 189 of the air flow disks 180 and are attached using the alignment pins 134. The insulation rings 186 are circular without the arced pathways and provide barriers to the transfer of heat from the heater core assembly 130 or insulation disks 180 and form a barrier to air flow from the air channel Z. A temperature zone 215 is formed from a first and second insulation ring 186*a* and 186*b* capping the layers of disks 180 and surrounding a heater core assembly 130 that is separately controlled by the furnace controller 216. A flow barrier disk 187 similar to an insulation ring 186 may be placed between the layered disks 180 within a temperature zone specifically to restrict axial flow of air from the active cooling system 222. This flow barrier 187 is particularly important in vertically oriented furnaces of lengthened temperature zones 215 that through convection cause air to move axial within the air channel Z along the furnace chamber. Disparate air flow may cause variations in temperature readings within a temperature zone 215 as described herein.

The disks 180 and rings 186, 187 are made out of low mass ceramic fiber composites such as alumina-silica insulation ($Al_2O_3SiO_2$) or of other insulation materials that have acceptable thermal conductivity and heat dissipation properties. The disks 180 and rings 186, 187 may be identical in size, thickness, and material or may be of any size or thickness to best assist in heat dissipation in a particular furnace design and/or heat-treatment application.

Figure 14:
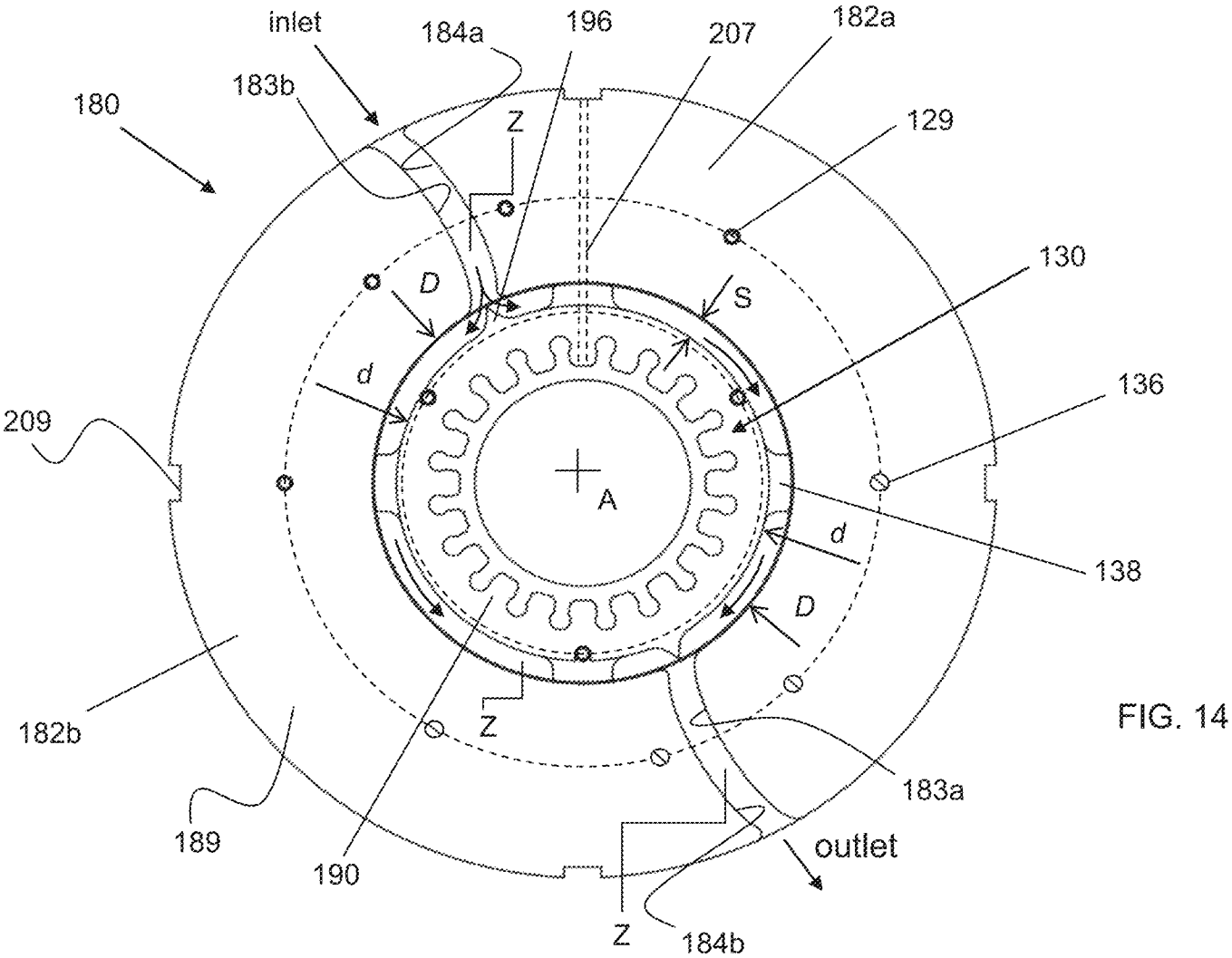
FIG. 14 is a top view of a first embodiment of a core assembly of the furnace system with active cooling in a first embodiment of the present invention.

As shown in FIG. 14, the heater core assembly 130 of each zone is positioned within the insulation disks 180 with the diameter d of the heater core assembly 130 being of a smaller diameter than the inner diameter D of the mated segments 182*a* and 182*b* of the insulation disks 180. The space S formed between the outer diameter d of the heater core assembly 130 and the inner diameter D forms the flow path for the air channel Z to extend from the inlet, through a first channel formed between the segments 183*b* and 184*a*, around the heater core assembly 130 to the second channel formed between the segments 183*a* and 184*b* and to the outlet.

Figure 15:
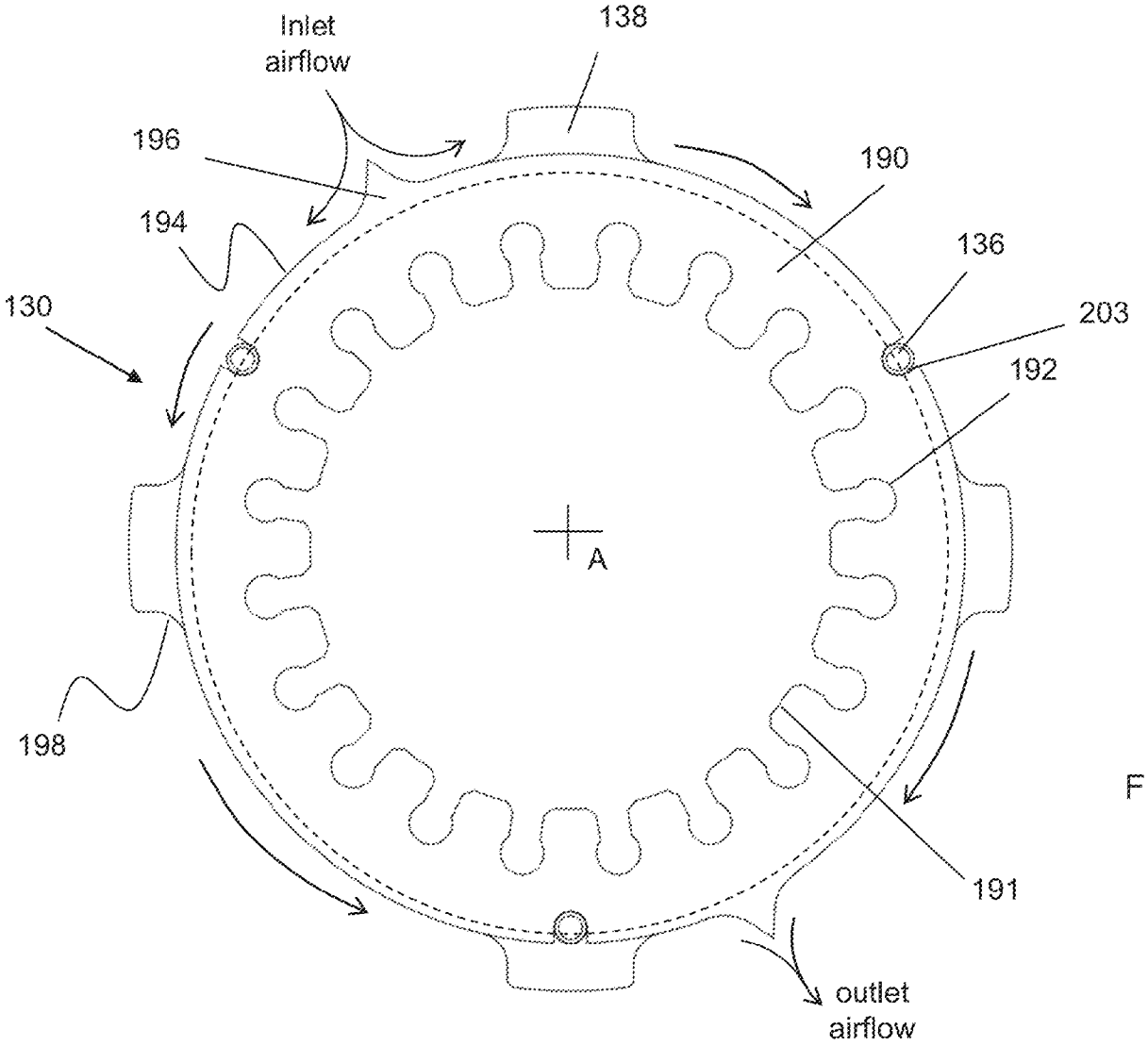
FIG. 15 is a top view of a first embodiment of a heater core assembly of the furnace system with active cooling in a first embodiment of the present invention.

As shown in FIG. 15, the heater core assembly 130 is formed from a set of layered conductive cores 190 made of a machinable ceramic with a pattern of circular cut-outs 192 that enclose the ribbon wire heating elements (not shown) that transmit heat to the furnace chamber. A partially rounded surface 191 extends out from the circular cut-outs 192 forming a surface around the usable work area within the furnace chamber. The heating elements 212 are electrically connected to the power distribution and control cabling within the electrical enclosure 122 with these connections further connected to the furnace controller 216. The outer surface 194 of the conductive cores 190 are formed with an air flow diffuser 196 that is aligned with the air channel Z of the insulations disks 180 to separate air flow from the active cooling system 222 and direct the flow around the heater core assembly 130. Any number of air flow diffusers 196 or air splitters may be formed in the machinable ceramic of the conductive core 190 to correspond to the number of active cooling systems 222 used in the furnace assembly 202.

Figure 16:
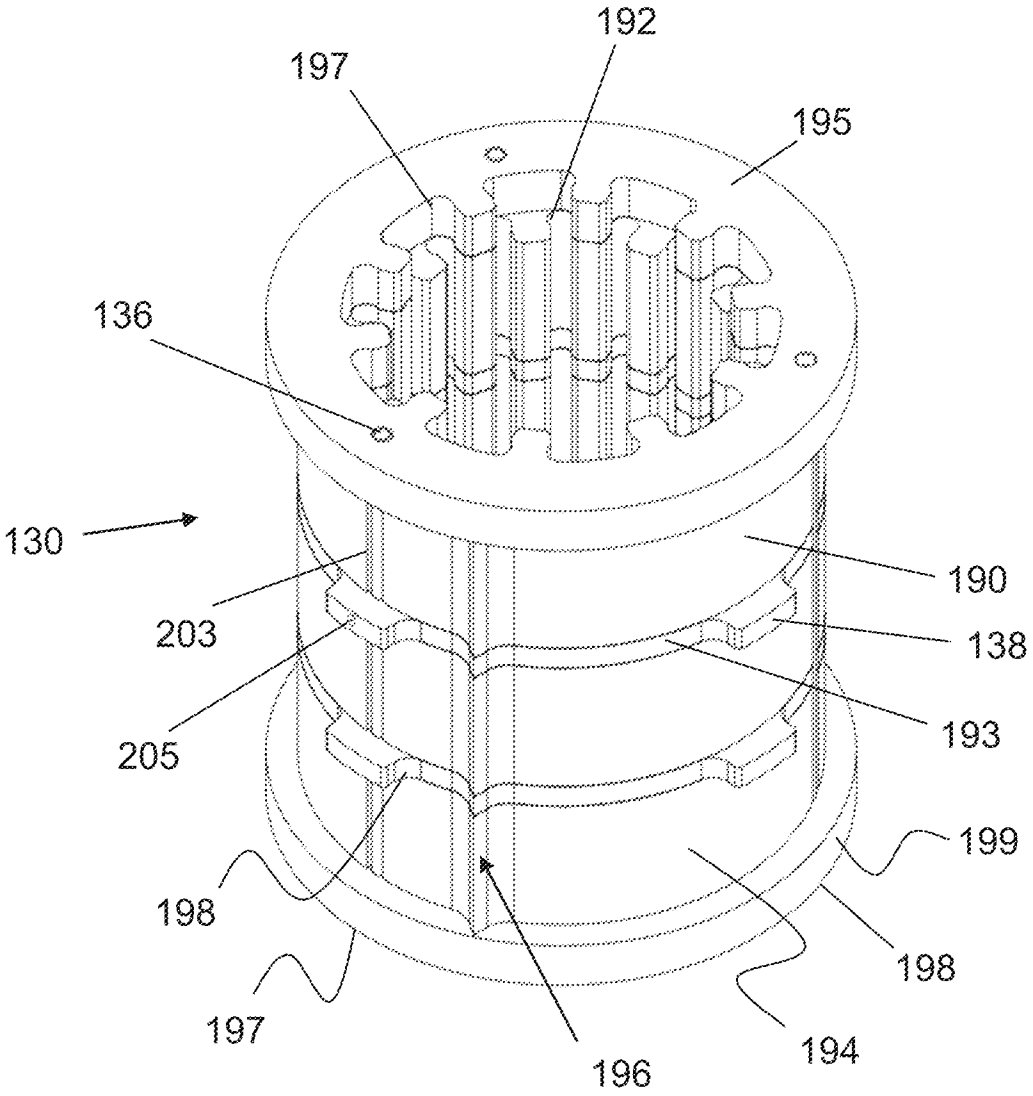
FIG. 16 is a perspective view of a first embodiment of a heater core assembly of the furnace system with active cooling in a first embodiment of the present invention.
Figure 17:
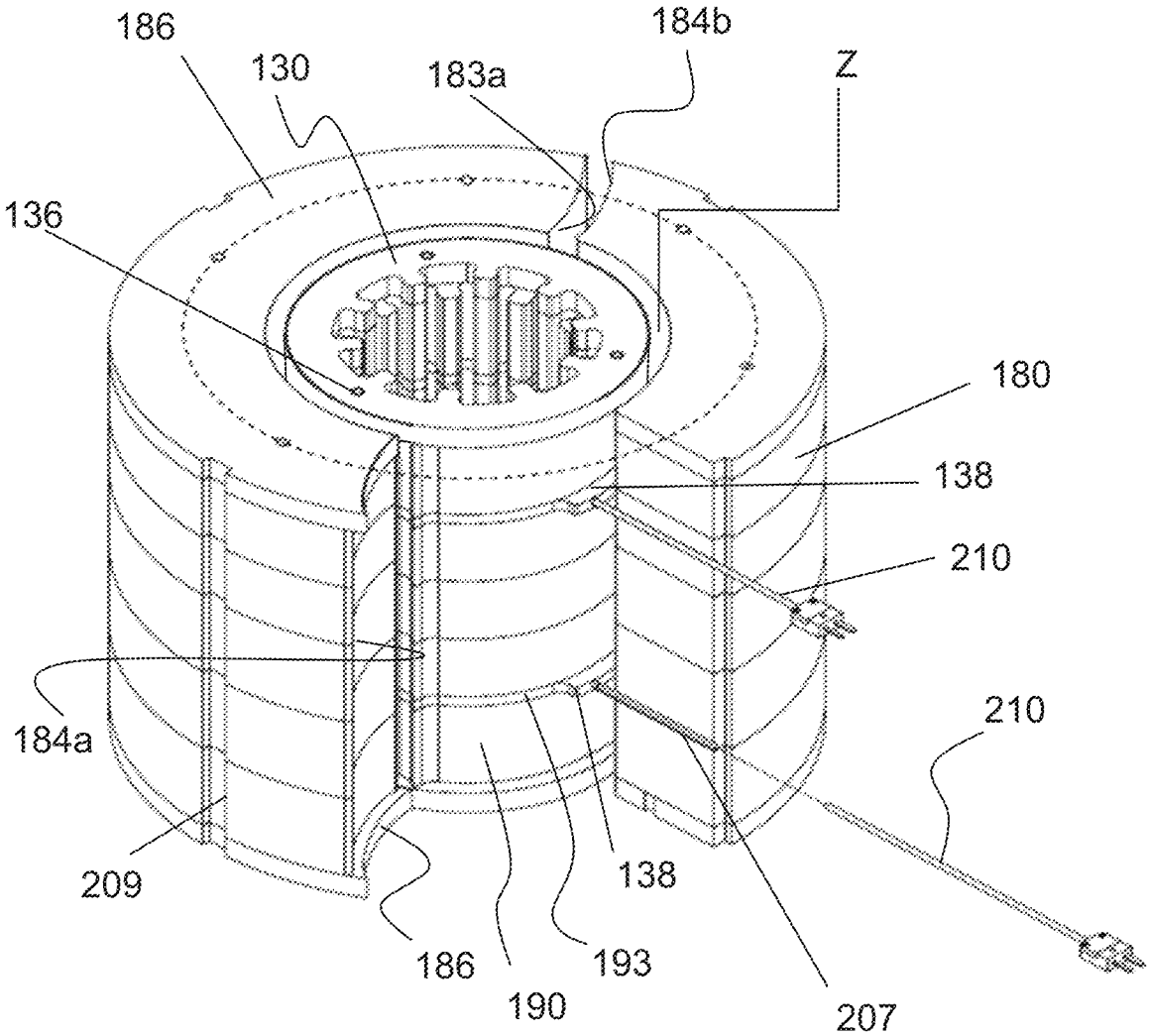
FIG. 17 is a perspective view of cut out of a first embodiment of a core assembly of the furnace system with active cooling in a first embodiment of the present invention.

From this top view of the heater core assembly 130, the spacer tabs 138 spaced concentrically around the center axis A are shown extending out from the partition spacers 193 that are layered underneath and between the conductive cores 190 as shown in FIG. 16. The spacer tabs 138 may be of any suitable dimension for air flow based on the temperature range requirements of the furnace 202. Each tab 138 has a rounded base 198 where it extends from the spacer 193 removing edges and promoting laminar flow around the heater core assembly 130. Alignment slots 203 may be cut into or through the conductive cores 190 and spacers 193 for the placement of the alignment rods or pins 136 to maintain a smooth outer edge on the heater core assembly 130 where in a first embodiment the alignment slots 203 are positioned equal distances around the center axis A. The heater core assembly 130 is comprised of alternating conductive cores 190 and the partition spacers 193. A non-conductive element plate 195 is positioned on each end of the heater core assembly 130 and the alignment pins 136 are inserted through holes 132 in the plate 195 and slots 203 along the outer surface 194 of the conductive cores 190 and spacers 193 to assemble the heater core 130.

By stacking the conductive cores 190 of each heater core assembly 130 a uniform temperature gradient that extends from one end of the heater core assembly 130 to the other may be programmed in or manually entered to set the temperature gradient within one region of the furnace chamber. The stacked heater core assemblies 130 create or lengthen the temperature zones 215 to provide for programming of required temperature gradients in each region of the furnace chamber to facilitate crystal growth or to perform other heat-treatment material process applications.

To properly measure the temperature within the furnace chamber, an opening 205 may be drilled through the spacer tab 138 or spacer 193 and the insulation disk 180 and an insulated conduit 207 and thermocouple or temperature sensor 210 may be installed within each heating zone 215. Alternatively, more than one temperature sensor 210 may be installed per heating zone 215 as required by the heat-treated materials process application. The insulating conduit 207 is inserted through the hole 205 that is drilled through an insulated disk 180 and the spacer 193 that is part of the heating core assembly 130 to the furnace chamber. The temperature sensor 210 is inserted within the conduit 207 to isolate the temperature sensor 210 from the heater core assembly 130 and insulation disk 180 in order to prevent distortions in temperature readings. The mounting bracket 124 provides for the electrical connection of the thermocouple or temperature sensor 210 to the furnace controller 216. The thermocouple mounting brackets 124 can be made from stainless-steel as well as any other material that can withstand the external heat of the furnace 202.

Since certain changes may be made in the above-described invention, without departing from the spirit and scope of the invention herein involved, it is intended that all of the subject matter of the above description or shown in the accompanying drawings shall be interpreted merely as examples illustrating the inventive concept herein and shall not be construed as limiting the invention.

What is claimed is:

1. A method of actively cooling a furnace comprising the steps of:

acquiring a furnace controller output from a furnace controller, the furnace controller output corresponding to an amount of power provided to a heating element, the heating element having an inner surface surrounding the usable work area within the furnace;

surrounding an outer surface of the heating element with an air flow channel configured to dissipate heat from the outer surface of the heating element;

centering the heating element within insulation;

isolating the insulation from the heating element to form the air flow channel;

forming an inlet to the air flow channel through the insulation within the furnace;

generating an active cooling control output based, at least in part, on the acquired furnace controller output, the active cooling control output configured to drive an active cooling element coupled to the furnace, the active cooling element configured to adjust a flow rate of a cooling medium and direct the cooling medium through the air flow channel and around the outer surface of the heating element to dissipate heat from the heating element in the furnace.

2. The method of actively cooling the furnace of claim 1, wherein the active cooling control output is related to the furnace controller output by a predetermined transfer characteristic.

3. The method of actively cooling the furnace of claim 1, wherein the furnace controller output is less than a low threshold and the active cooling control output is at or near a maximum, corresponding to a maximum flow rate of the cooling medium configured to cool a zone of the furnace.

4. The method of actively cooling the furnace of claim 1, wherein the furnace controller output is greater than a high threshold and the active cooling control output is at or near a minimum, corresponding to a minimum flow rate of the cooling medium configured to facilitate temperature uniformity within a zone of the furnace.

5. The method of actively cooling the furnace of claim 1, wherein the furnace controller output is below a range of optimal power levels for the furnace and the active cooling control output is at a value configured to allow the cooling medium to dissipate sufficient heat in a zone of the furnace to cause the furnace controller to increase furnace controller output to within the range of optimal power levels.

6. The method of actively cooling the furnace of claim 1, further comprising the step of:

determining whether a process is completed based on a duration that the acquired furnace controller output is less than a low threshold.

7. The method of actively cooling the furnace of claim 3 wherein the low threshold is 5% and the maximum of the active cooling control output is 100%.

8. The method of actively cooling the furnace of claim 4 wherein the high threshold is 50% and the minimum of the active cooling control output is 5%.

9. The method of actively cooling the furnace of claim 5 wherein the range of optimal power levels for the furnace is 50% to 70%.

10. The method of actively cooling the furnace of claim 1, comprising determining an operating state of the furnace as heating, holding, cooling or completing based on a predetermined period of time and change in furnace controller output.

11. The method of actively cooling the furnace of claim 1, comprising:

forming a plurality of zones within the furnace, each zone having a separate furnace controller output, heating element, air flow channel, active cooling control output, and active cooling element.

12. The method of actively cooling the furnace of claim 11, comprising:

creating a temperature gradient within the furnace by adjusting the flow rate of a cooling medium within one of the plurality of zones to hold a first zone at a target temperature; and adjusting the flow rate of a cooling medium within another of the plurality of zones to hold a second zone at a target temperature different from the first zone.

13. A furnace system with active cooling comprising:

active cooling control circuitry configured to acquire a furnace controller output from a furnace controller, the furnace controller output corresponding to an amount of power provided to a heating element, the heating element having an inner surface surrounding the usable work area within the furnace;

an air flow channel surrounding an outer surface of the heating element and configured to dissipate heat from the outer surface of the heating element;

insulation isolated from the heating element to form the air flow channel, the insulation having an inlet path to the air flow channel;

an active cooling element coupled to the furnace, the cooling element configured to flow a cooling medium in the air flow channel surrounding the heating element, the air flow channel associated with a zone of the furnace; and wherein the active cooling control circuitry is configured to generate an active cooling control output based, at least in part, on the acquired furnace controller output, the active cooling control output configured to drive the active cooling element to adjust a flow rate of the cooling medium and dissipate heat from the heating element.

14. The furnace system with active cooling of claim 13, wherein the active cooling control circuitry comprises:

a processor configured to execute an active cooling application, and a memory coupled to the processor, the memory configured to store the active cooling application and a predetermined transfer characteristic configured to relate the active cooling control output to the acquired furnace controller output.

15. The furnace system with active cooling of claim 13, wherein the active cooling control output is configured to drive the active cooling element to achieve a maximum flow rate of the cooling medium when the acquired furnace controller output is less than or equal to a predetermined low threshold, the maximum flow rate of the cooling medium configured to cool an associated zone of the furnace.

16. The furnace system with active cooling of claim 13, wherein the active cooling control output is configured to drive the active cooling element to achieve a minimum flow rate of the cooling medium when the acquired furnace controller output is greater than or equal to a predetermined high threshold, the minimum flow rate of the cooling medium configured to facilitate accurate temperature sensing in an associated zone of the furnace.

17. The furnace with active cooling of claim 13, wherein the active cooling control circuitry comprises a timer configured to provide a measure of a duration of time that the furnace controller output is equal to or less than a low threshold, a magnitude of the duration configured to differentiate between a cooling state within a process and a cooling state at a completion of the process.

18. The furnace system with active cooling of claim 13, wherein the active cooling control output is configured to drive the active cooling element to adjust a flow rate of the cooling medium from a moderate to an ultra-low speed when the acquired furnace controller output is less than or equal to a predetermined high threshold and greater than or equal to a predetermined low threshold when acquired over a predetermined period of time, the change in flow rate of the cooling medium configured to dissipate heat from the heating element and facilitate maintaining a small variation and more constant temperature of a target temperature in a zone of the furnace.

19. The furnace system with active cooling of claim 13, wherein the air flow channel having mating surfaces that form an arc shape.

20. The furnace system with active cooling of claim 13, the active cooling element comprising a plurality of fans attached to a funnel bracket having slots to isolate air flow to a specific zone of the furnace.

* * * * *